US009643101B2

(12) United States Patent
Acerra

(10) Patent No.: US 9,643,101 B2
(45) Date of Patent: May 9, 2017

(54) CONSTRUCTION SYSTEM USING A COMB CONNECTOR

(71) Applicant: Michael James Acerra, Galesburg, IL (US)

(72) Inventor: Michael James Acerra, Galesburg, IL (US)

( * ) Notice: Subject to any disclaimer, the term of this patent is extended or adjusted under 35 U.S.C. 154(b) by 0 days.

(21) Appl. No.: 15/276,769

(22) Filed: Sep. 26, 2016

(65) Prior Publication Data

US 2017/0014728 A1 Jan. 19, 2017

Related U.S. Application Data

(63) Continuation of application No. 14/211,319, filed on Mar. 14, 2014, now abandoned.

(51) Int. Cl.

| | |
|---|---|
| ***A63H 33/00*** | (2006.01) |
| ***A63H 33/08*** | (2006.01) |
| ***A63H 33/04*** | (2006.01) |
| ***A63H 33/10*** | (2006.01) |

(52) U.S. Cl.

CPC ..... *A63H 33/086* (2013.01); *A63H 33/044* (2013.01); *A63H 33/084* (2013.01); *A63H 33/105* (2013.01)

(58) Field of Classification Search

CPC .. A63H 33/086; A63H 33/108; A63H 33/102; A63H 33/084; A63H 33/105; Y10T 403/7045

See application file for complete search history.

(56) References Cited

U.S. PATENT DOCUMENTS

| | | | | | |
|---|---|---|---|---|---|
| 2,057,942 | A | * | 10/1936 | Fay | A63H 33/108 217/65 |
| 2,776,521 | A | * | 1/1957 | Zimmerman | A63H 33/065 16/227 |
| 3,271,895 | A | * | 9/1966 | Sphirensen | A63H 33/102 16/386 |
| 3,442,044 | A | * | 5/1969 | Quercetti | A63F 9/06 428/47 |
| 3,991,511 | A | * | 11/1976 | McAllister | A63H 33/06 428/192 |
| 4,055,019 | A | * | 10/1977 | Harvey | A63F 9/12 220/315 |
| 4,606,732 | A | * | 8/1986 | Lyman | A63H 33/086 446/104 |
| D285,585 | S | * | 9/1986 | Murdough, Jr. | D21/491 |
| 4,685,892 | A | * | 8/1987 | Gould | A63H 33/062 446/109 |
| 4,731,041 | A | * | 3/1988 | Ziegler | A63H 33/065 446/102 |

(Continued)

*Primary Examiner* — Victor MacArthur

(74) *Attorney, Agent, or Firm* — Michael J. Foycik, Jr.

(57) ABSTRACT

A construction system uses a comb connector element in combination with flat or generally planar polygonal shapes of various types. The comb connector elements connect to the edges of the planar polygonal shapes. Each comb connector has at least one pair of connector members. Each connector member has a proximal end connected to the polygonal member, and a distal end. Each connector member having a face portion that includes a recess extending from a central region of the face portion. The recess extends to the distal end of the face member.

4 Claims, 38 Drawing Sheets

(56) References Cited

U.S. PATENT DOCUMENTS 4,886,477 A * 12/1989 Ziegler ..... A63H 33/065 446/104
5,183,430 A * 2/1993 Swann ..... A63H 33/04 446/104
5,590,668 A * 1/1997 Macy ..... A45D 8/34 132/200
5,833,511 A * 11/1998 Outman ..... A63H 33/10 446/104
6,116,980 A * 9/2000 Bauer ..... A63H 33/04 446/104
6,186,855 B1 * 2/2001 Bauer ..... A63H 33/04 446/104
6,565,406 B2 * 5/2003 Huang ..... A63H 33/042 446/104
6,648,715 B2 * 11/2003 Wiens ..... A63H 33/062 446/121
6,665,993 B2 * 12/2003 Sorensen ..... A63H 33/062 16/224
6,925,770 B2 * 8/2005 Sorensen ..... A63H 33/062 403/119
6,966,435 B2 * 11/2005 Weiser ..... B65G 17/08 198/850
D513,628 S * 1/2006 Andersen ..... D21/404
7,556,136 B2 * 7/2009 Marshall ..... B65G 47/71 198/370.09
7,588,476 B2 * 9/2009 Hammond ..... A63H 33/086 446/104
7,648,407 B1 * 1/2010 Sorensen ..... A63H 33/084 446/120
7,749,042 B2 * 7/2010 Fulgenzi ..... A63H 33/06 446/108
7,808,247 B1 * 10/2010 Lo ..... G01R 31/021 324/533
8,104,607 B2 * 1/2012 Webb ..... B65G 19/287 198/861.2
8,187,050 B1 * 5/2012 Sorensen ..... A63H 33/084 446/120
8,210,892 B2 * 7/2012 Thrush ..... A63F 9/1288 446/108
8,231,425 B1 * 7/2012 Haas ..... A63H 33/048 24/442
8,366,507 B2 * 2/2013 Chen ..... A63H 33/086 446/108
2003/0082986 A1 * 5/2003 Wiens ..... A63H 33/062 446/120
2010/0194039 A1 * 8/2010 Thrush ..... A63F 9/1288 273/153 R

* cited by examiner

CONSTRUCTION SYSTEM USING A COMB CONNECTOR

CROSS REFERENCE TO RELATED APPLICATIONS

This application claims the priority of Utility patent application U.S. Ser. No. 14/211,319 filed on Mar. 14, 2014 for inventor Michael James Acerra entitled "Construction System Using a Comb Connector" and which in turn claims the benefit of Provisional Application No. 61/801,751 filed on Mar. 15, 2013, inventor Michael James Acerra, entitled "Construction System Using a Comb Connector".

STATEMENT REGARDING FEDERALLY SPONSORED RESEARCH OR DEVELOPMENT

Not applicable.

FIELD OF THE INVENTION

The present invention relates to construction kits, construction elements, and connectors for construction elements.

BACKGROUND OF THE INVENTION

It is a problem in the art to provide construction kits, construction elements, and connectors for construction elements, that are relatively reliably secured when connected, are relatively low in cost to manufacture, and are relatively easy to connect.

SUMMARY OF THE INVENTION

From the foregoing, it is seen that it is a problem in the art to provide an apparatus and system of elements meeting the above requirements. According to the present invention, an apparatus and system of elements is provided which meets the aforementioned requirements and needs in the prior art.

Specifically, the device according to the present invention provides a construction kit, a variety of construction elements, and novel connectors for construction elements. The construction elements are relatively reliably secured when connected, relatively low in cost to manufacture, and are relatively easy to connect.

The device of the present invention provides a construction system that uses a comb connector element in combination with flat or generally planar polygonal shapes such as, but not limited to, triangles, squares, rectangles, pentagons, hexagons, heptagons, octagons, and so on. The invention can be used on a small scale as a toy or on a larger scale to build structures such as, but not limited to, houses, outhouses, stables, and office buildings, among others.

The present invention is directed to at least one comb connector element in combination with generally planar polygonal shapes such as, but not limited to, triangles, squares, rectangles, pentagons, hexagons, heptagons, and octagons.

A plurality of comb connector elements and polygonal shapes can be used to build three dimensional shapes such as polyhedrons, e.g., a dodecahedron and an octagonal prism. The planar polygonal shapes can be regular or irregular polygonal flat or substantially flat shapes.

The comb connector elements connect to the edges of the planar polygonal shapes. Each comb connector has at least one pair of connector members. Each connector member has a proximal end connected to the polygonal member, and a distal end. Each connector member having a face portion that includes a recess extending from a central region of the face portion. The recess extends to the distal end of the face member.

In additional to the aforementioned planar polygonal members, there are other construction elements that are not substantially planar or polygonal. Further, the polygonal members are not necessarily planar, and can have three dimensional extent. Additionally, the polygonal members can include empty interior regions which can include pairs of the comb connector members.

Other objects and advantages of the present invention will be more readily apparent from the following detailed description when read in conjunction with the accompanying drawings.

BRIEF DESCRIPTION OF THE DRAWINGS

FIG. 93 is a top/bottom view of the element of FIG. 92.

FIG. 119 is an assembly view showing insertion of a pin into a hole in one of the elements.

FIG. 120 is a perspective view of a hermaphroditic connector element, according to the present invention.

FIG. 121 is a top elevational view of the hermaphroditic connector element of FIG. 120.

FIG. 122 is a side elevational view of the hermaphroditic connector element of FIG. 120.

FIG. 123 is a perspective view of the connection of two hermaphroditic connector elements of FIG. 120.

FIG. 124 is an assembly view of the connection of the two hermaphroditic connector elements of FIG. 123.

FIG. 125 is a perspective view of a stick-like element, according to the present invention.

FIG. 126 is a front elevational view of the stick-like element of FIG. 125.

FIG. 127 is a side elevational view of the stick-like element of FIG. 125.

FIG. 128 is an end elevational view of the stick-like element of FIG. 125.

FIG. 129 is an assembly view showing use of the stick connector of FIGS. 125-128.

FIG. 130 is a schematic view of the pin and ridge connection of two corresponding ones of a pair of connector members, according to the present invention.

Figure 131:
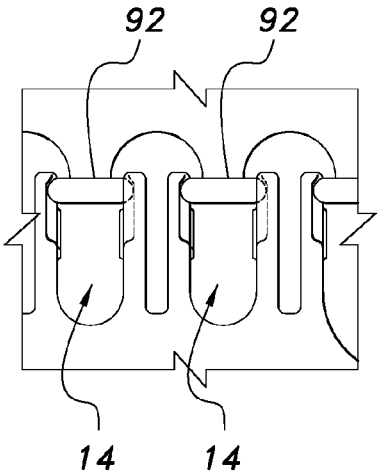

FIG. 131 is a schematic view of the insertion of male elements into respective ones of a plurality of pairs of connector members, according to the present invention.

Figure 132:
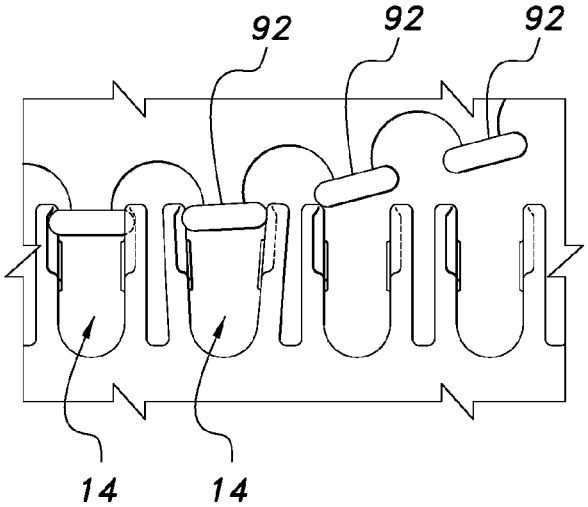

FIG. 132 is a schematic view showing a zipper-like unlocking of the connections of the male elements into respective ones of a plurality of pairs of connector members of FIG. 131.

Figure 130:
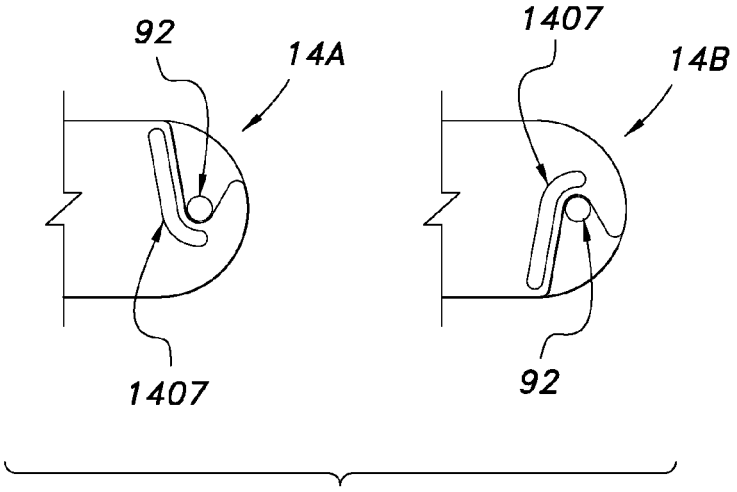
Figure 133:
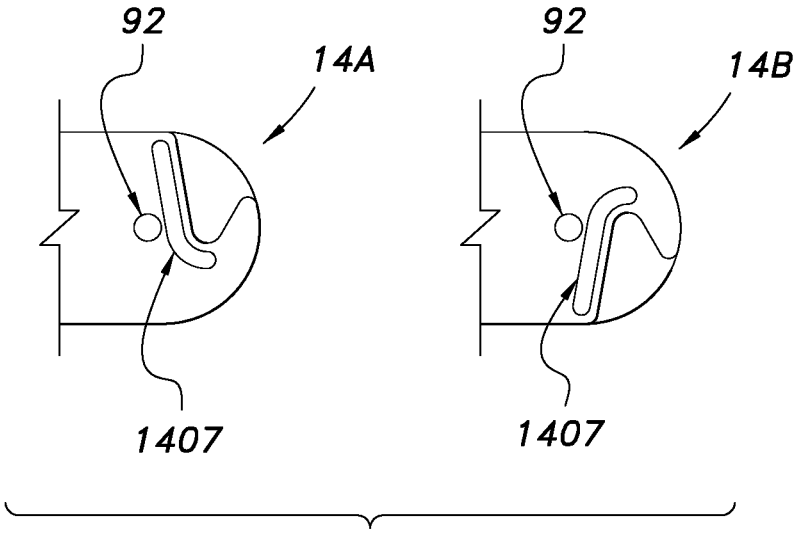

FIG. 133 is an enlarged view, similar to FIG. 130, showing a different type of locking engagement of the male elements behind the ridge members.

Figure 134:
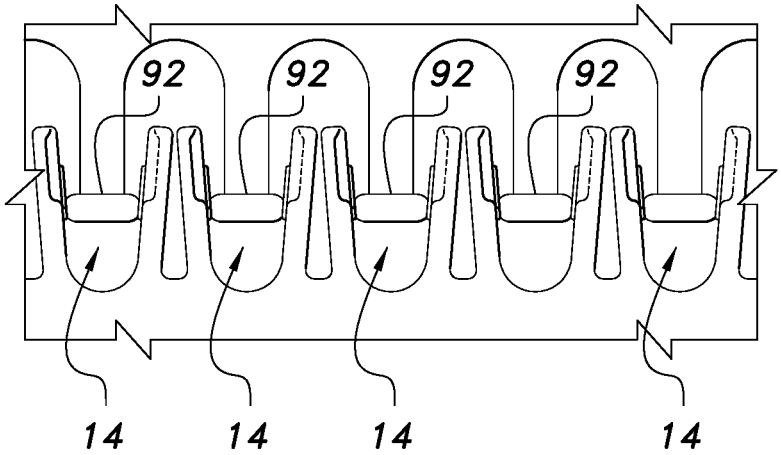

FIG. 134 is a schematic view of the insertion of male elements into respective ones of a plurality of pairs of connector members, for the locking arrangement shown in FIG. 133.

Figure 135:
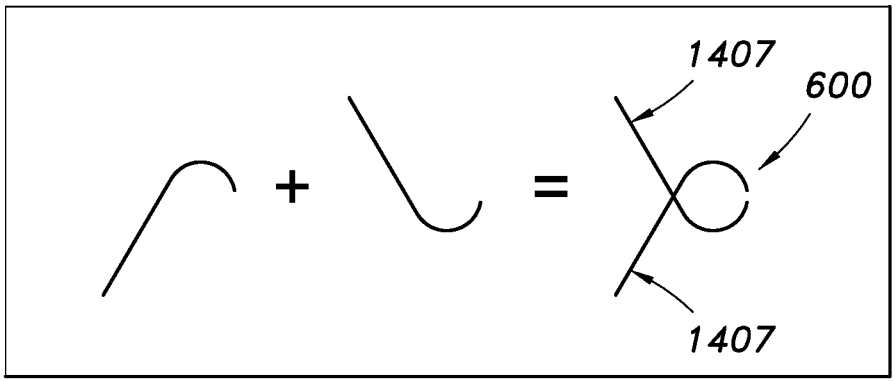

FIG. 135 is a schematic view showing the ridge members in overlapping side view, to illustrate the oppositely directed connecting scheme of the present invention.

Figure 136:
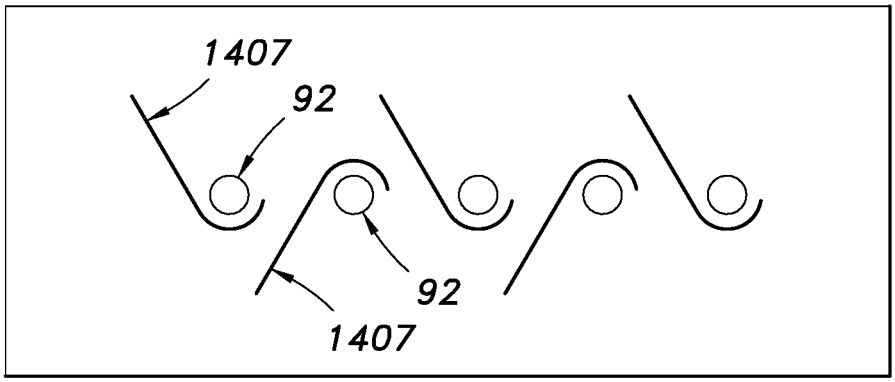

FIG. 136 is a schematic view similar to FIG. 135, showing a plurality of pairs of the ridge members and male elements in side view, to illustrate the oppositely directed connecting scheme of the present invention.

DETAILED DESCRIPTION OF THE INVENTION

Figure 1:
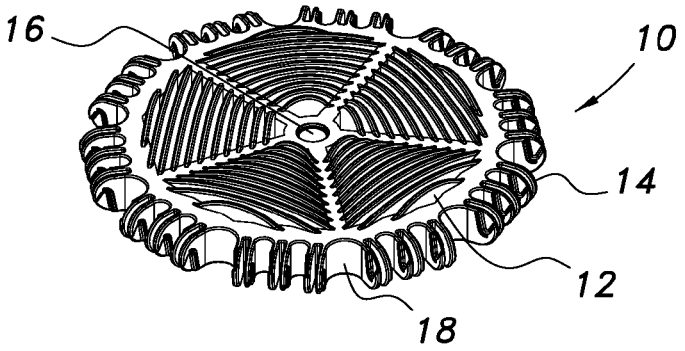
FIG. 1 is a perspective view of a decagonal planar element, according to the present invention.

The device of the present invention provides a construction system shown in FIGS. 1-135 that uses a comb connector element in combination with flat or generally planar polygonal shapes such as, but not limited to, triangles, squares, rectangles, pentagons, hexagons, heptagons, octagons, and so on. The invention can be used on a small scale as a toy or on a larger scale to build structures such as, but not limited to, houses, outhouses, stables, and office buildings, among others.

The present invention is directed to at least one comb connector element in combination with generally planar polygonal shapes such as, but not limited to, triangles, squares, rectangles, pentagons, hexagons, heptagons, and octagons.

A plurality of comb connector elements and polygonal shapes can be used to build three dimensional shapes such as polyhedrons, e.g., a dodecahedron and an octagonal prism. The planar polygonal shapes can be regular or irregular polygonal flat or substantially flat shapes. The comb connector elements connect to the edges of the planar polygonal shapes.

The construction system uses at least one comb connector element in combination with flat or generally planar polygonal members having polygonal shapes of various types. Preferably, each of the polygonal members have a plurality of such comb connector elements.

The comb connector elements connect to the edges of the planar polygonal shapes. Each comb connector has at least one pair of connector members. Each connector member has a proximal end connected to the polygonal member, and a distal end. Each connector member having a face portion that includes a recess extending from a central region of the face portion. The recess extends to the distal end of the face member.

In additional to the aforementioned planar polygonal members, there are other construction elements that are not substantially planar or polygonal. Further, the polygonal members are not necessarily planar, and can have three dimensional extent. Additionally, the polygonal members can include empty interior regions which can include pairs of the comb connector members.

FIG. 1 is a perspective view of a decagonal planar element 10. The element 10 has a plurality of connector pairs 14 (each composed of connector elements 14A and 14B shown in greater detail in FIGS. 110-117), which together form a comb connector. The element 10 has a body 12 having grill-like features, a central aperture 16, and a gap 18 to accommodate male element connections and to provide docking room.

Hereafter, all features in the following figures having the connector pairs similar to pairs 14 are understood to be comb connectors. Also, the gaps in the following figures similar to gap 18 will be understood to accommodate male element connections.

Figure 2:
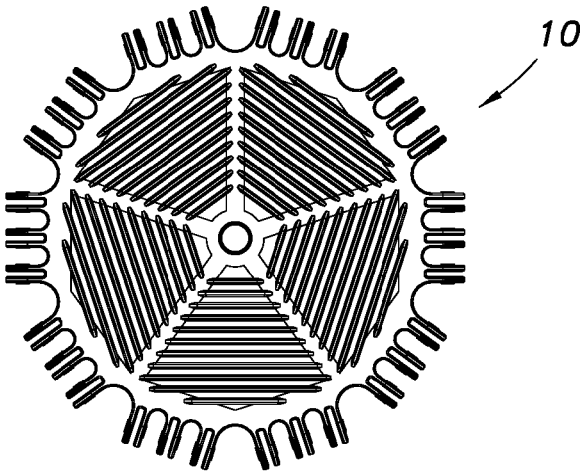
FIG. 2 is a top elevational view of the element of FIG. 1

FIG. 2 is a top elevational view of the element 10 of FIG. 1

Figure 3:
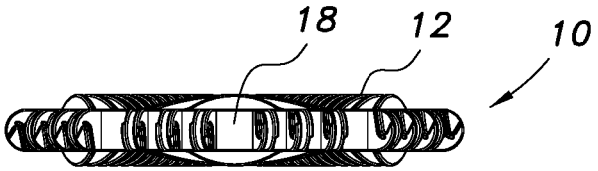
FIG. 3 is a side elevational view of the element of FIG. 1.

FIG. 3 is a side elevational view of the element 10 of FIG. 1.

Figure 4:
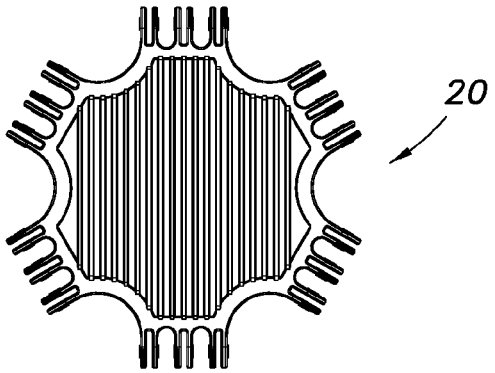
FIG. 4 is a top view of a hexagonal planar element, according to the present invention.

FIG. 4 is a top view of a hexagonal planar element 20. The element 20 has a plurality of connector pairs 22 (each composed of connector elements 14A and 14B shown in greater detail in FIGS. 110-117), which together form a comb connector. The element 20 has a body 24 having grill-like features, and a gap 26 to accommodate male element connections and to provide docking room.

The grill-like features of the body 24 are able to accommodate connection to other elements, such as the stick-like element 340 of FIGS. 125-128, and other grill-like features of other such elements.

Figure 5:
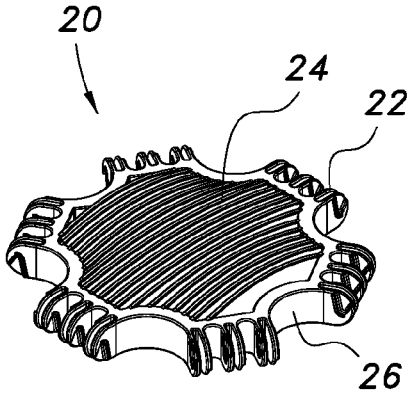
FIG. 5 is a perspective view of the element of FIG. 4.

FIG. 5 is a perspective view of the element 20 of FIG. 4.

Figure 6:
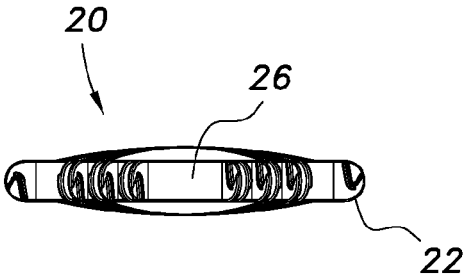
FIG. 6 is a side elevational view of the element of FIG. 4.

FIG. 6 is a side elevational view of the element 20 of FIG. 4.

Figure 7:
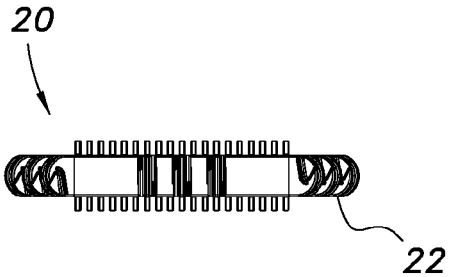
FIG. 7 is a front/back view of the element of FIG. 4.

FIG. 7 is a front/back view of the element 20 of FIG. 4.

Figure 8:
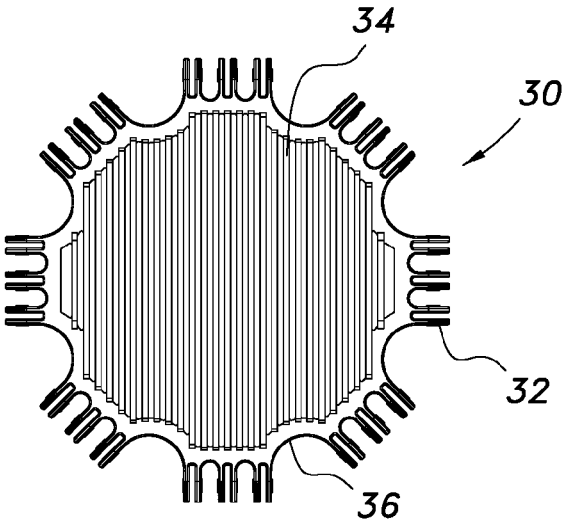
FIG. 8 is a top view of an octagonal planar element, according to the present invention.

FIG. 8 is a top view of an octagonal planar element 30. The element 30 has a plurality of connector pairs 32 (each composed of connector elements 14A and 14B shown in greater detail in FIGS. 110-117), which together form a comb connector. The element 30 has a body 34 having grill-like features, and a gap 36 to accommodate male element connections and to provide docking room.

Figure 9:
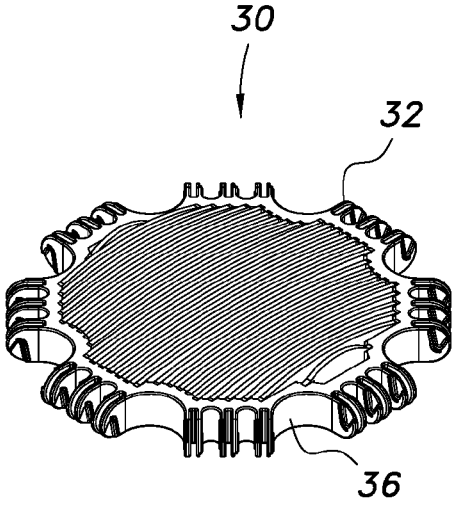
FIG. 9 is a perspective view of the element of FIG. 8.

FIG. 9 is a perspective view of the element 30 of FIG. 8.

Figure 10:
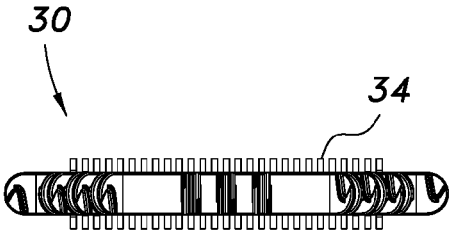
FIG. 10 is a front/back elevational view of the element of FIG. 8.

FIG. 10 is a front/back elevational view of the element 30 of FIG. 8.

Figure 11:
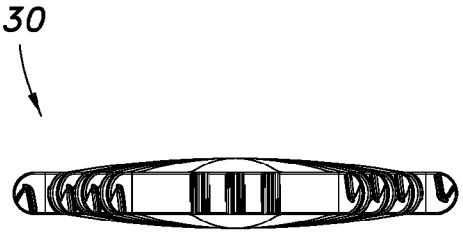
FIG. 11 is a side view of the element of FIG. 8.

FIG. 11 is a side view of the element 30 of FIG. 8.

Figure 12:
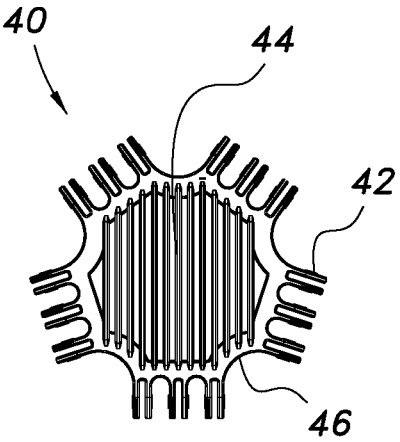
FIG. 12 is a top view of a pentagonal planar element, according to the present invention.

FIG. 12 is a top view of a pentagonal planar element 40. The element 40 has a plurality of connector pairs 42 (each composed of connector elements 14A and 14B shown in greater detail in FIGS. 110-117), which together form a comb connector. The element 40 has a body 44 having grill-like features, and a gap 46 to accommodate male element connections and to provide docking room.

Figure 13:
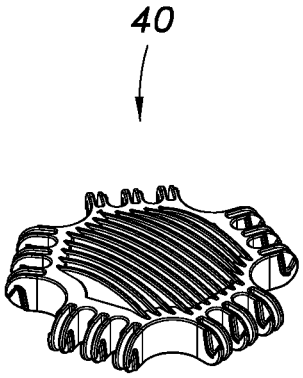
FIG. 13 is a perspective view of the element of FIG. 12.

FIG. 13 is a perspective view of the element 40 of FIG. 12.

Figure 14:
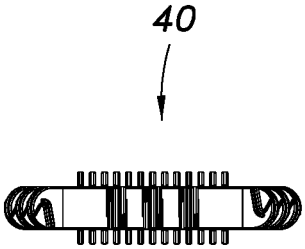
FIG. 14 is a front/back elevational view of the element of FIG. 12.

FIG. 14 is a front/back elevational view of the element 40 of FIG. 12.

Figure 15:
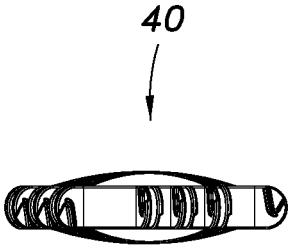
FIG. 15 is a side view of the element of FIG. 12.

FIG. 15 is a side view of the element 40 of FIG. 12.

Figure 16:
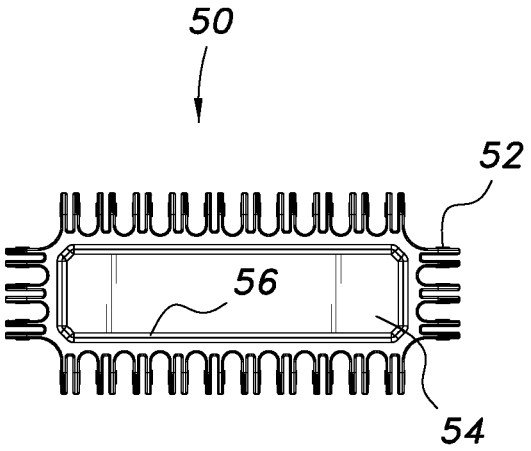
FIG. 16 is a top/bottom view of a rectangular element, according to the present invention.

FIG. 16 is a top/bottom view of a rectangular element 50. The element 50 has a plurality of connector pairs 52 (each composed of connector elements 14A and 14B shown in greater detail in FIGS. 110-117), which together form a comb connector. The element 50 has a body 54, and a ledge 56. It also includes a gap (unnumbered) similar to the preceding figures, to accommodate male element connections and to provide docking room.

Figure 17:
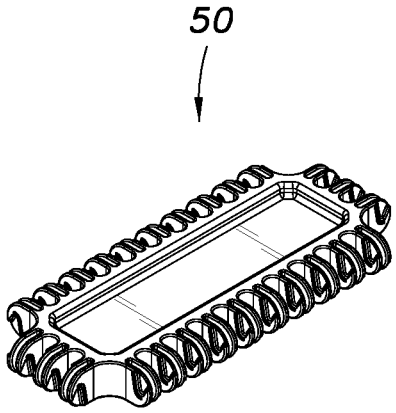
FIG. 17 is a perspective view of the element of FIG. 16.

FIG. 17 is a perspective view of the element 50 of FIG. 16.

Figure 18:
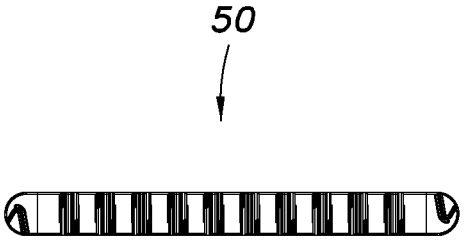
FIG. 18 is a front/back elevational view of the element of FIG. 16.

FIG. 18 is a front/back elevational view of the element 50 of FIG. 16.

Figure 19:
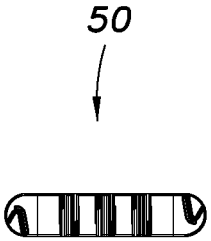
FIG. 19 is a side view of the element of FIG. 16.

FIG. 19 is a side view of the element 50 of FIG. 16.

Figure 20:
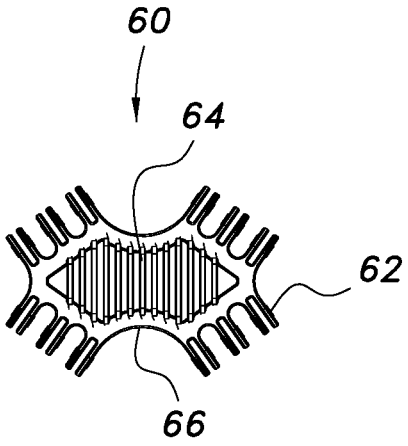
FIG. 20 is a top/bottom view of a rhombus planar element, according to the present invention.

FIG. 20 is a top/bottom view of a rhombus planar element 60. The element 60 has a plurality of connector pairs 62 (each composed of connector elements 14A and 14B shown in greater detail in FIGS. 110-117), which together form a comb connector. The element 60 has a body 64 having grill-like features, and a gap 66 to accommodate male element connections and to provide docking room.

Figure 21:
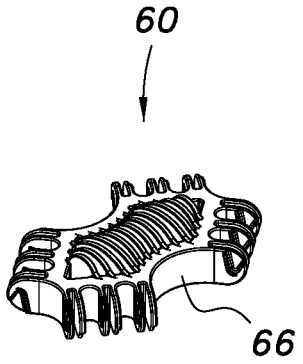
FIG. 21 is a perspective view of the element of FIG. 20.

FIG. 21 is a perspective view of the element 60 of FIG. 20.

Figure 22:
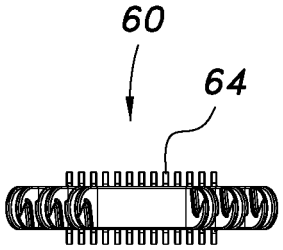
FIG. 22 is a front/back view of the element of FIG. 20.

FIG. 22 is a front/back view of the element 60 of FIG. 20.

Figure 23:
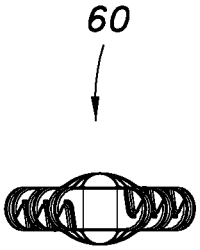
FIG. 23 is a side view of the element of FIG. 20.

FIG. 23 is a side view of the element 60 of FIG. 20.

Figure 24:
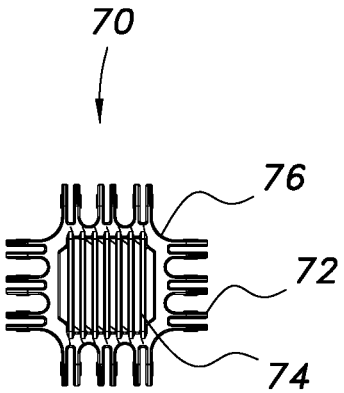
FIG. 24 is a top view of a square planar element, according to the present invention.

FIG. 24 is a top view of a square planar element 70. The element 70 has a plurality of connector pairs 72 (each composed of connector elements 14A and 14B shown in greater detail in FIGS. 110-117), which together form a comb connector. The element 70 has a body 74 having grill-like features, and a gap 76 to accommodate male element connections and to provide docking room.

Figure 25:
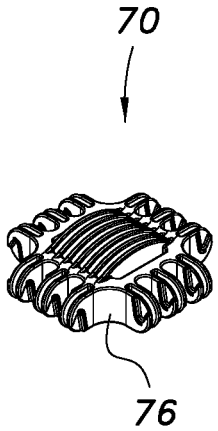
FIG. 25 is a perspective view of the element of FIG. 24.

FIG. 25 is a perspective view of the element 70 of FIG. 24.

Figure 26:
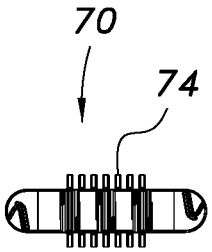
FIG. 26 is a front/back elevational view of the element of FIG. 24.

FIG. 26 is a front/back elevational view of the element 70 of FIG. 24.

Figure 27:
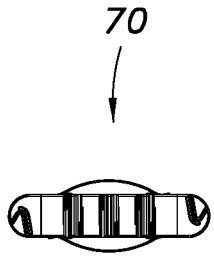
FIG. 27 is a side view of the element of FIG. 24.

FIG. 27 is a side view of the element 70 of FIG. 24.

Figure 28:
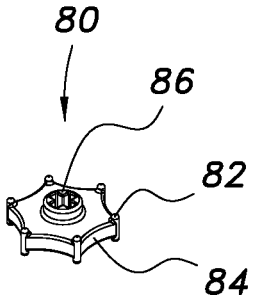
FIG. 28 is a perspective view of a hexagonal male connector element, according to the present invention.

FIG. 28 is a perspective view of a hexagonal male connector element 80. The element 80 has a body 84, a ridge 86 surrounding a central aperture 88 (shown in FIG. 29) and a plurality of male connectors 82. Each of the male connectors 82 is adapted to be received between the pairs of connector members which have been described hereinabove. The element 80 also includes the cross-shaped aperture 88 there through to receive other connecting members described further herein below.

Figure 29:
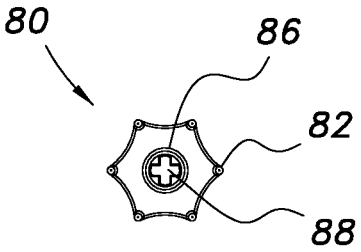
FIG. 29 is a top/bottom view of the element of FIG. 28.

FIG. 29 is a top/bottom view of the element 80 of FIG. 28.

Figure 30:
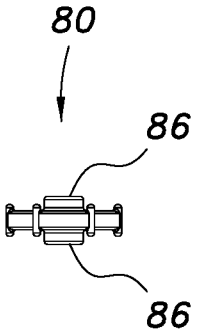
FIG. 30 is a side elevational view of the element of FIG. 28.

FIG. 30 is a side elevational view of the element 80 of FIG. 28.

Figure 31:
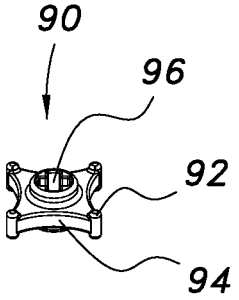
FIG. 31 is a perspective view of a four male connector element according to the present invention.

FIG. 31 is a perspective view of a four male connector element 90. The element 90 has a body 94, a ridge 96 surrounding a central aperture 98 (shown in FIG. 32) and a plurality of male connectors 92. Each of the male connectors 92 is adapted to be received between the pairs of connector members which have been described hereinabove. The element 90 also includes the cross-shaped aperture 98 there through to receive other connecting members described further herein below.

Figure 32:
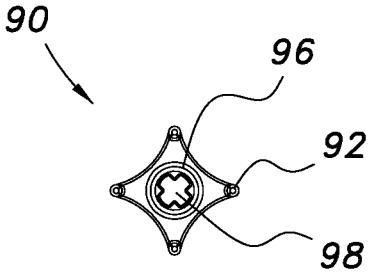
FIG. 32 is a top/bottom view of the element of FIG. 31.

FIG. 32 is a top/bottom view of the element 90 of FIG. 31.

Figure 33:
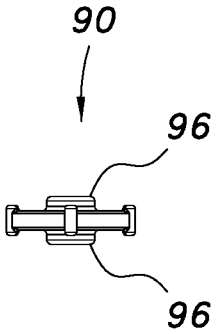
FIG. 33 is a side elevational view of the element of FIG. 31.

FIG. 33 is a side elevational view of the element 90 of FIG. 31.

Figure 34:
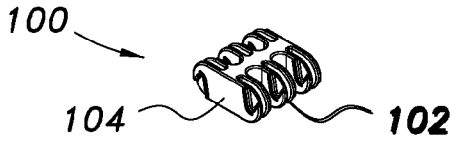
FIG. 34 is a perspective view of a short element according to the present invention.

FIG. 34 is a perspective view of a short element 100, which is a two-sided comb connector. The element 100 has a body 104 and connector elements 102 (each composed of connector elements 14A and 14B shown in greater detail in FIGS. 110-117).

Figure 35:
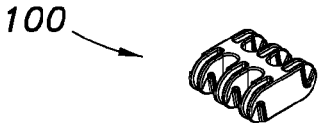
FIG. 35 is another perspective view of the element of FIG. 34.

FIG. 35 is another perspective view of the element 100 of FIG. 34.

Figure 36:
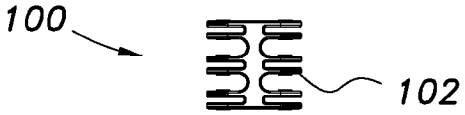
FIG. 36 is a top/bottom view of the element of FIG. 34.

FIG. 36 is a top/bottom view of the element 100 of FIG. 34.

Figure 37:
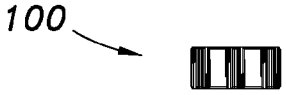
FIG. 37 is a front/back view of the element of FIG. 34.

FIG. 37 is a front/back view of the element 100 of FIG. 34.

Figure 38:
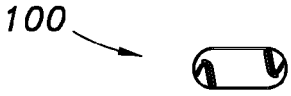
FIG. 38 is a side view of the element of FIG. 34.

FIG. 38 is a side view of the element 100 of FIG. 34.

Figure 39:
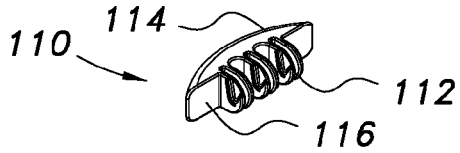
FIG. 39 is a perspective view of a wheel element according to the present invention.

FIG. 39 is a perspective view of a wheel element 110. The element 110 has a curved side 114, connector elements 112, and a body 116.

Figure 40:
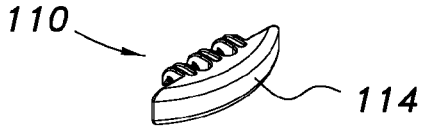
FIG. 40 is another perspective view of the element of FIG. 39.

FIG. 40 is another perspective view of the element 110 of FIG. 39.

Figure 41:
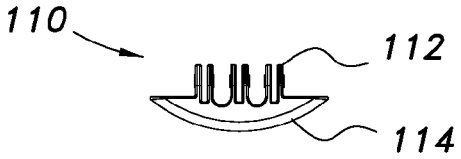
FIG. 41 is a top/bottom view of the element of FIG. 39.

FIG. 41 is a top/bottom view of the element 110 of FIG. 39.

Figure 42:
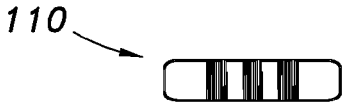
FIG. 42 is a front/back view of the element of FIG. 39.

FIG. 42 is a front/back view of the element 110 of FIG. 39.

Figure 43:
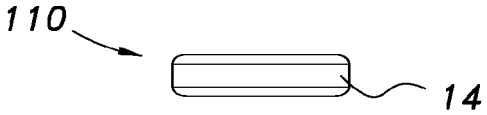
FIG. 43 is a side view of the element of FIG. 39.

FIG. 43 is a side view of the element 110 of FIG. 39.

Figure 44:
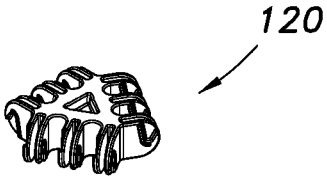
FIG. 44 is a perspective view of a triangular element according to the present invention.
Figure 46:
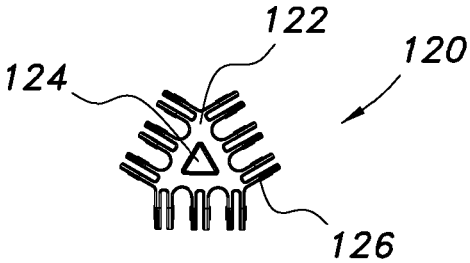
FIG. 46 is a top/bottom view of the element of FIG. 44.

FIG. 44 is a perspective view of a triangular element 120. As shown in FIG. 46, element 120 has connector pairs 126, a central aperture 124, and a body 122.

Figure 45:
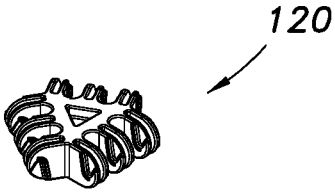
FIG. 45 is another perspective view of the element of FIG. 44.

FIG. 45 is another perspective view of the element 120 of FIG. 44.

FIG. 46 is a top/bottom view of the element 120 of FIG. 44.

Figure 47:
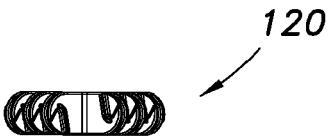
FIG. 47 is a front view of the element of FIG. 44.

FIG. 47 is a front view of the element 120 of FIG. 44.

Figure 48:
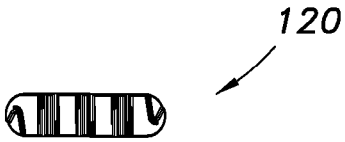
FIG. 48 is a back view of the element of FIG. 44.

FIG. 48 is a back view of the element 120 of FIG. 44.

Figure 49:
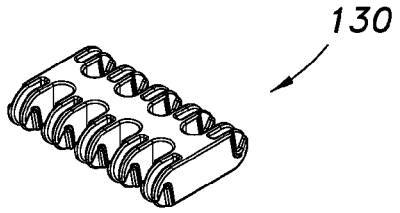
FIG. 49 is a perspective view of a two-sided female connector element according to the present invention.

FIG. 49 is a perspective view of a two-sided female connector element 130. The element 130 (as shown in FIG. 51) includes connector pairs 132, a body 136, and ends 134.

Figure 50:
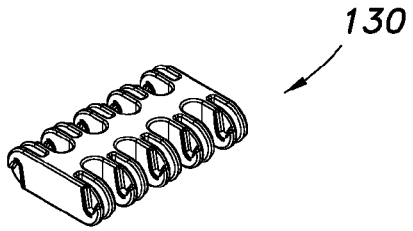
FIG. 50 is another perspective view of the element of FIG. 49.

FIG. 50 is another perspective view of the element 130 of FIG. 49.

Figure 51:
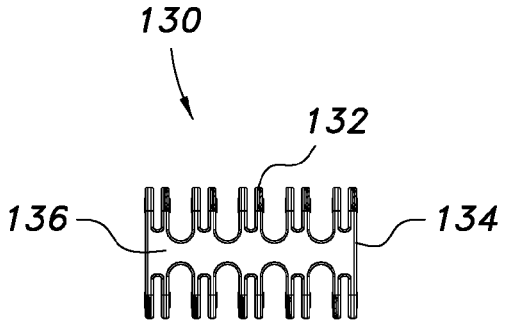
FIG. 51 is a top/bottom view of the element of FIG. 49.

FIG. 51 is a top/bottom view of the element 130 of FIG. 49.

Figure 52:
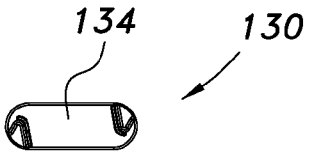
FIG. 52 is a side view of the element of FIG. 49.

FIG. 52 is a side view of the element 130 of FIG. 49.

Figure 53:
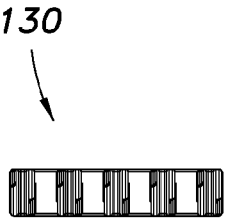
FIG. 53 is a front/back view of the element of FIG. 49.

FIG. 53 is a front/back view of the element 130 of FIG. 49.

Figure 54:
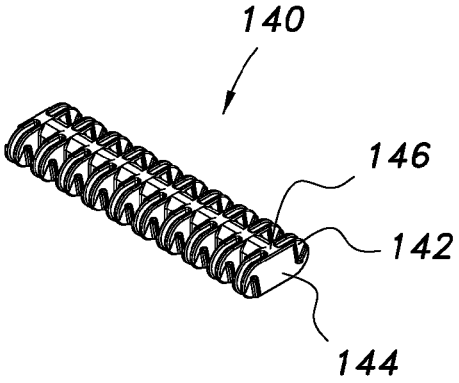
FIG. 54 is a perspective view of a long two sided female connector element according to the present invention.

FIG. 54 is a perspective view of a long two sided female connector element 140. The element 140 includes connector pairs 142, a body 146, and ends 144.

Figure 55:
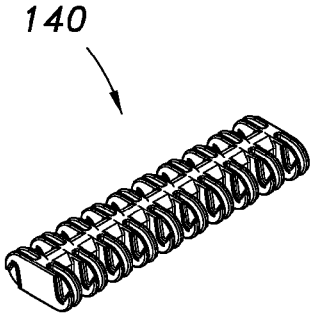
FIG. 55 is another perspective view of the element of FIG. 54.

FIG. 55 is another perspective view of the element 140 of FIG. 54.

Figure 56:
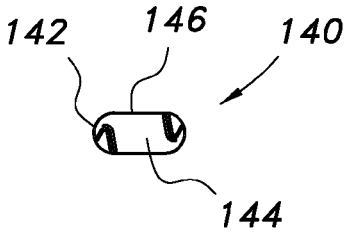
FIG. 56 is a side view of the element of FIG. 54.

FIG. 56 is a side view of the element 140 of FIG. 54.

Figure 57:
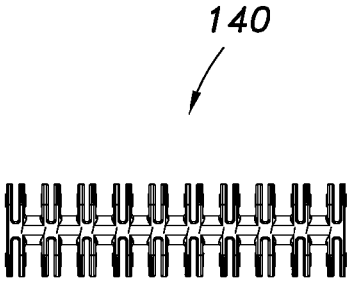
FIG. 57 is a top/bottom view of the element of FIG. 54.

FIG. 57 is a top/bottom view of the element 140 of FIG. 54.

Figure 58:
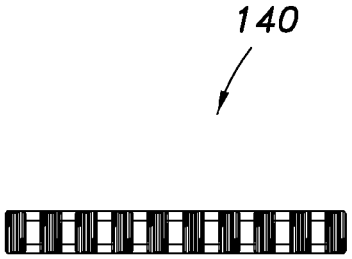
FIG. 58 is a front/back view of the element of FIG. 54.

FIG. 58 is a front/back view of the element 140 of FIG. 54.

Figure 59:
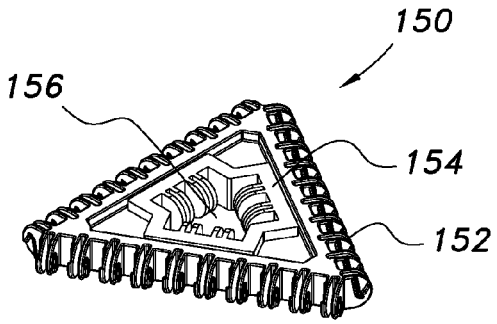
FIG. 59 is a perspective view of a triangular planar element according to the present invention.

FIG. 59 is a perspective view of a triangular planar element 150. The element 150 has an exterior comb connector having connector pairs 152 and an interior comb connector having connector pairs (unnumbered) projecting from interior wall 154 which surrounds an aperture 156.

Figure 60:
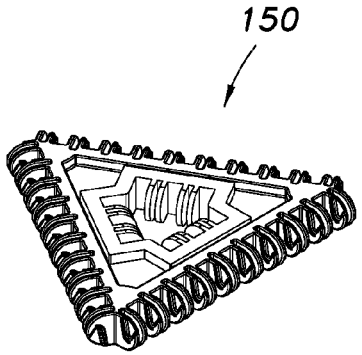
FIG. 60 is another perspective view of the element of FIG. 59.

FIG. 60 is another perspective view of the element 150 of FIG. 59.

Figure 61:
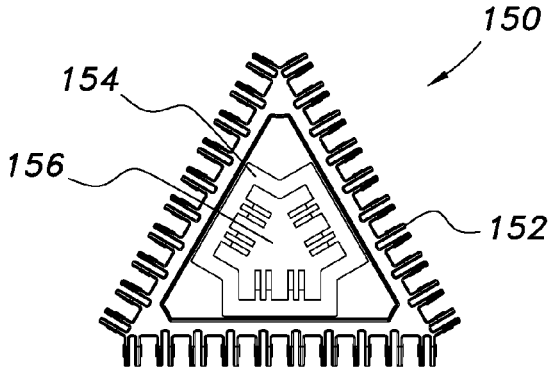
FIG. 61 is a top/bottom view of the element of FIG. 59.

FIG. 61 is a top/bottom view of the element 150 of FIG. 59.

Figure 62:
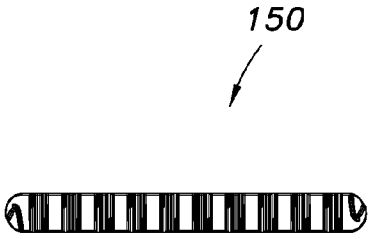
FIG. 62 is a back view of the element of FIG. 59.

FIG. 62 is a back view of the element 150 of FIG. 59.

Figure 63:
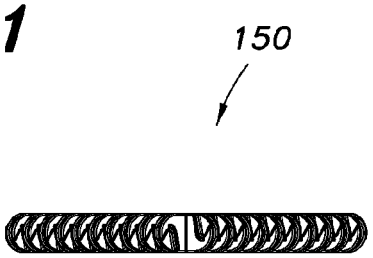
FIG. 63 is a front view of the element of FIG. 59.

FIG. 63 is a front view of the element 150 of FIG. 59.

Figure 64:
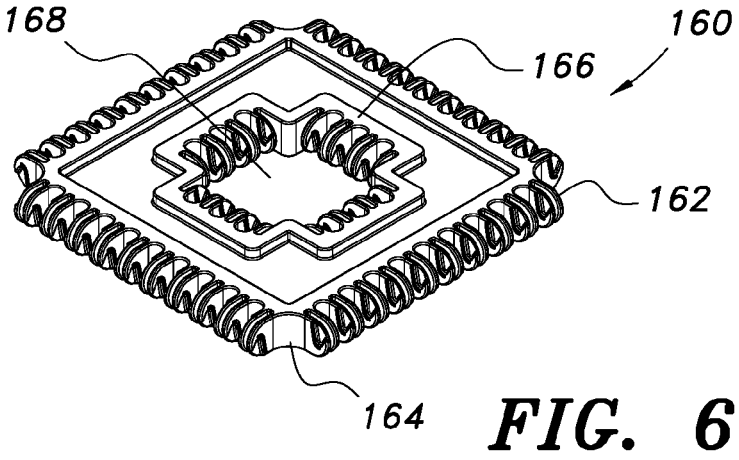
FIG. 64 is a perspective view of a square planar element according to the present invention.

FIG. 64 is a perspective view of a square planar element 160. The element 160 has an exterior comb connector having connector pairs 162 and an interior comb connector having connector pairs (unnumbered) projecting from interior wall 166 which surrounds an aperture 168. The element 160 has a gap 164 to accommodate male element connections and to provide docking room.

Figure 65:
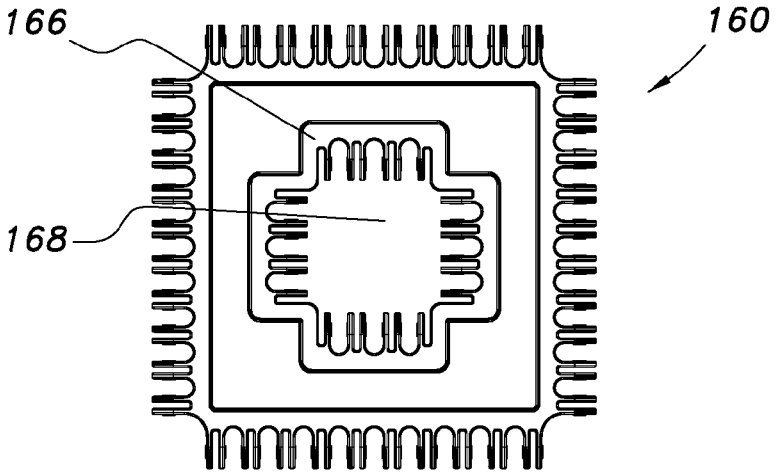
FIG. 65 is a top/bottom view of the element of FIG. 64.

FIG. 65 is a top/bottom view of the element 160 of FIG. 64.

Figure 66:
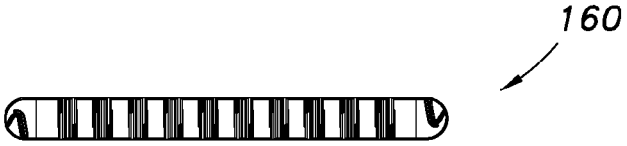
FIG. 66 is a side view of the element of FIG. 64.

FIG. 66 is a side view of the element 160 of FIG. 64.

Figure 67:
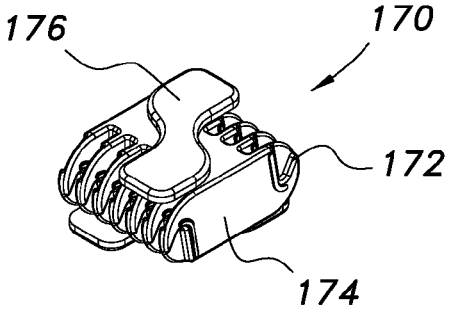
FIG. 67 is a perspective view of an angle locking hinge stop element according to the present invention.

FIG. 67 is a perspective view of an angle locking hinge stop element 170. The element 170 has a plurality of connector pairs 172 (each composed of connector elements 14A and 14B shown in greater detail in FIGS. 110-117), which together form a comb connector. The element 170 has a body 174, and a stiffener member 176 disposed on the body 174.

The element 170 serves as a brake and limits angular movement between two comb connectors. Element 170 therefore limits bending.

Figure 68:
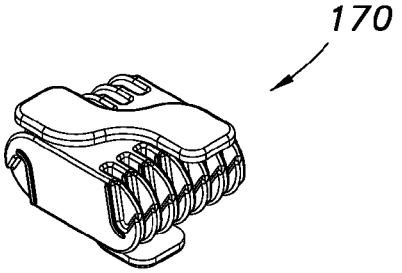
FIG. 68 is another perspective view of the element of FIG. 67.

FIG. 68 is another perspective view of the element 170 of FIG. 67.

Figure 69:
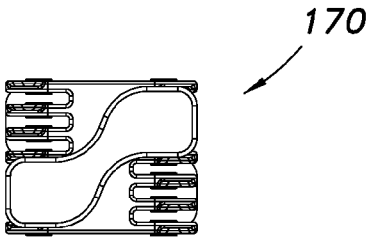
FIG. 69 is a top/bottom view of the element of FIG. 67.

FIG. 69 is a top/bottom view of the element 170 of FIG. 67.

Figure 70:
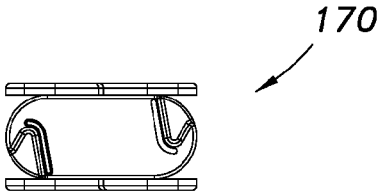
FIG. 70 is a front/back view of the element of FIG. 67.

FIG. 70 is a front/back view of the element 170 of FIG. 67.

Figure 71:
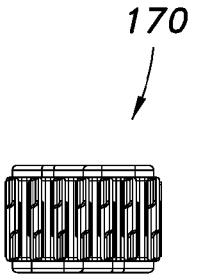
FIG. 71 is a side view of the element of FIG. 67.

FIG. 71 is a side view of the element 170 of FIG. 67.

Figure 72:
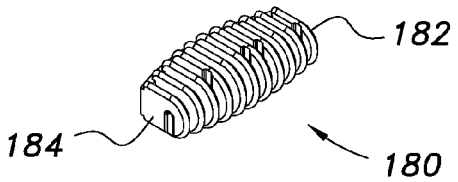
FIG. 72 is a perspective view of a hermaphroditic hinge connector element according to the present invention.

FIG. 72 is a perspective view of a hermaphroditic hinge connector element 180. The element 180 provides a pinless hinge wherein each comb connector element has both male and female elements in the body of the comb connector. The element 180 has a body 184 and pairs of connector members 182.

Figure 73:
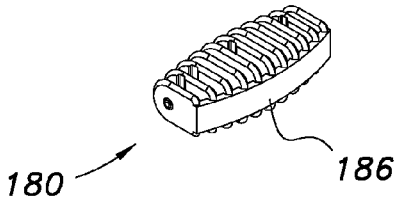
FIG. 73 is another perspective view of the element of FIG. 72.

FIG. 73 is another perspective view of the element 180 of FIG. 72.

Figure 74:
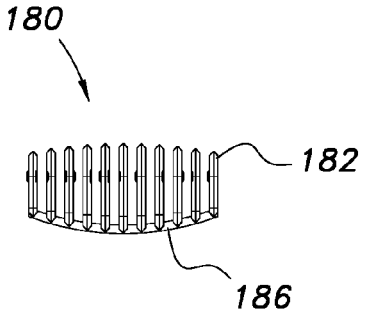
FIG. 74 is a top/bottom view of the element of FIG. 72.

FIG. 74 is a top/bottom view of the element 180 of FIG. 72.

Figure 75:
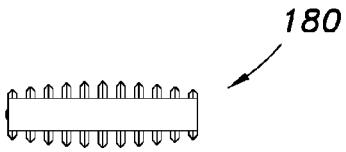
FIG. 75 is a front view of the element of FIG. 72.

FIG. 75 is a front view of the element 180 of FIG. 72.

Figure 76:
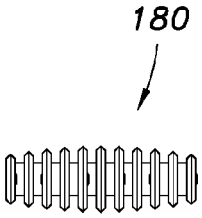
FIG. 76 is a back view of the element of FIG. 72.

FIG. 76 is a back view of the element of FIG. 72.

Figure 77:
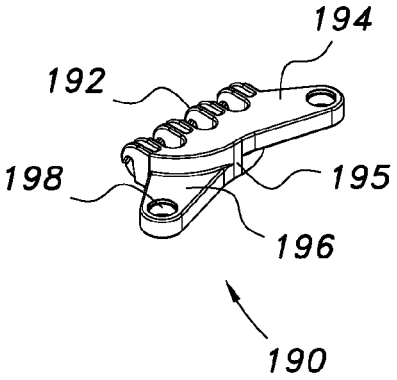
FIG. 77 is a perspective view of a unity block element according to the present invention.

FIG. 77 is a perspective view of a unity block element 190. The element 190 has comb connectors 192, a first body portion 194, a second body portion 196, and pin female orifices 198.

Figure 78:
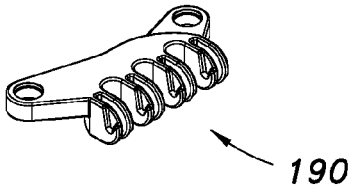
FIG. 78 is another perspective view of the element of FIG. 77.

FIG. 78 is another perspective view of the element 190 of FIG. 77.

Figure 79:
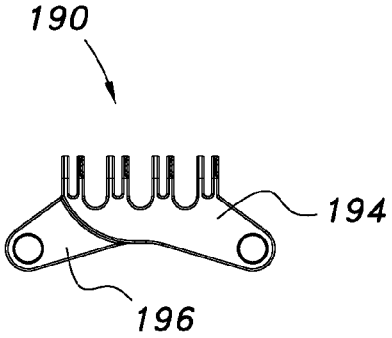
FIG. 79 is a top/bottom view of the element of FIG. 77.

FIG. 79 is a top/bottom view of the element 190 of FIG. 77.

Figure 80:
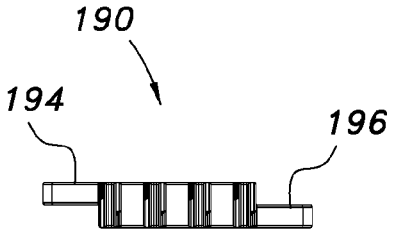
FIG. 80 is a front/back view of the element of FIG. 77.

FIG. 80 is a front/back view of the element 190 of FIG. 77.

Figure 81:
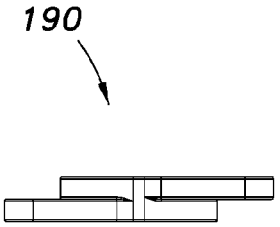
FIG. 81 is a front/back view of the element of FIG. 77.

FIG. 81 is a front/back view of the element 190 of FIG. 77.

Figure 82:
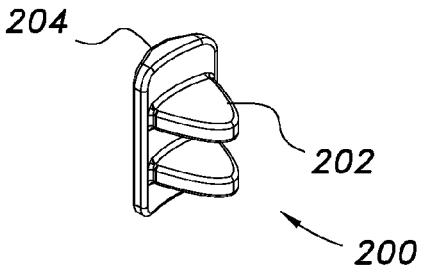
FIG. 82 is a perspective view of a lock element according to the present invention.

FIG. 82 is a perspective view of a lock element 200. The lock element 200 is used by inserting it into the hinge connection between two female-to-female connections. It limits the angular motion (i.e. the bending moment) of these female-to-female connections. The element 200 has a curved side 204 and two projecting male members 202.

Figure 83:
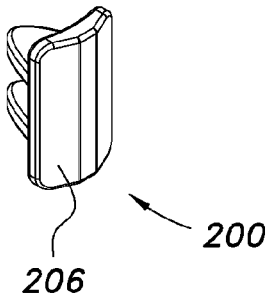
FIG. 83 is another perspective view of the lock element of FIG. 82, according to the present invention.

FIG. 83 is another perspective view of the lock element 200 of FIG. 82, according to the present invention.

Figure 84:
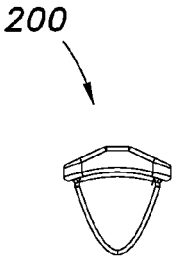
FIG. 84 is another perspective view of the element of FIG. 83.

FIG. 84 is another perspective view of the element 200 of FIG. 83.

Figure 85:
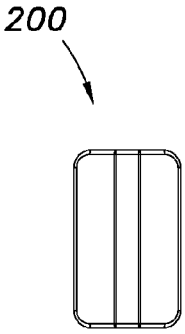
FIG. 85 is a front view of the element of FIG. 82.

FIG. 85 is a front view of the element 200 of FIG. 82.

Figure 86:
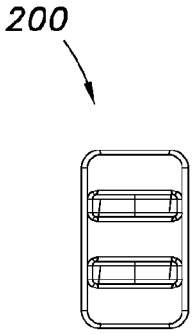
FIG. 86 is a back view of the element of FIG. 82.

FIG. 86 is a back view of the element 200 of FIG. 82.

Figure 87:
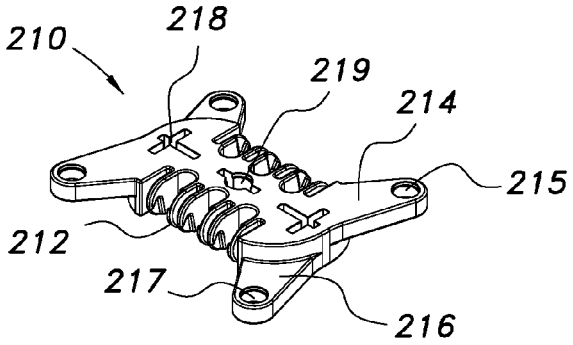
FIG. 87 is a perspective view of a utility block element according to the present invention.

FIG. 87 is a perspective view of a utility block element 210. The element 210 has comb connectors 212, a central aperture 219, a first body portion 214, a second body portion 216, cross-shaped apertures 218, and pin female orifices 217. The apertures 218 are intended to receive the elements 300 (described hereunder).

Figure 88:
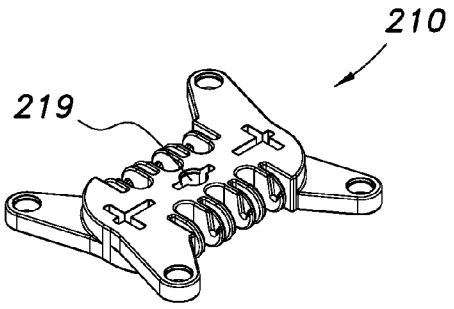
FIG. 88 is another perspective view of the element of FIG. 87.

FIG. 88 is another perspective view of the element 210 of FIG. 87.

Figure 89:
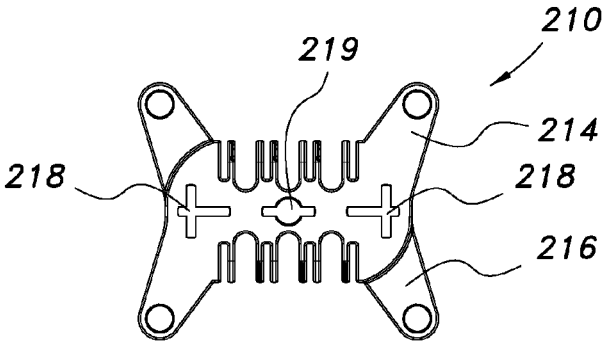
FIG. 89 is a top/bottom view of the element of FIG. 87.

FIG. 89 is a top/bottom view of the element 210 of FIG. 87.

Figure 90:
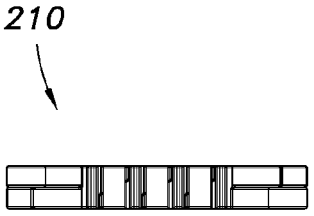
FIG. 90 is a front/back view of the element of FIG. 87.

FIG. 90 is a front/back view of the element 210 of FIG. 87.

Figure 91:
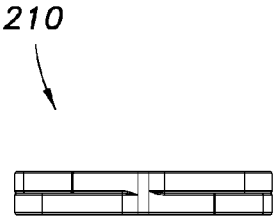
FIG. 91 is a side view of the element of FIG. 87.

FIG. 91 is a side view of the element 210 of FIG. 87.

Figure 92:
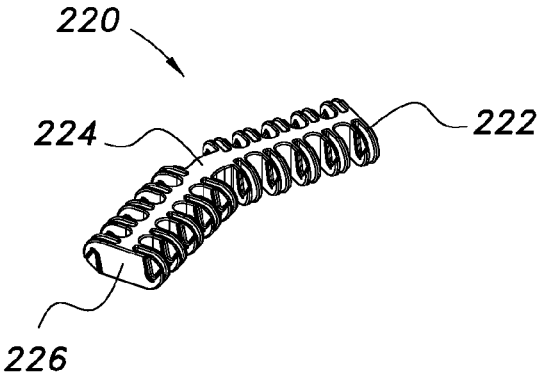
FIG. 92 is a perspective view of an angular element having a 120 degree angle, according to the present invention.

FIG. 92 is a perspective view of an angular element 220 having a 120 degree angle. The element 220 has comb connectors 222, an angled bend 224, and a body 226.

Figure 93:
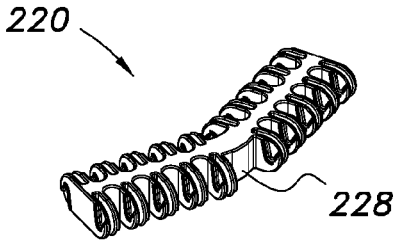
FIG. 93 is another perspective view of the element of FIG. 92.

FIG. 93 is another perspective view of the element 220 of FIG. 92.

FIG. 93 is a top/bottom view of the element 220 of FIG. 92.

Figure 94:
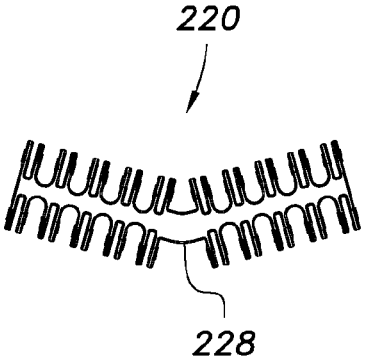
FIG. 94 is a front view of the element of FIG. 92.

FIG. 94 is a front view of the element 220 of FIG. 92.

Figure 95:
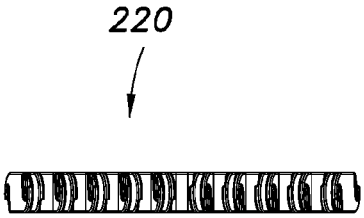
FIG. 95 is a front view of the element of FIG. 92.

FIG. 95 is a front view of the element 220 of FIG. 92.

Figure 96:
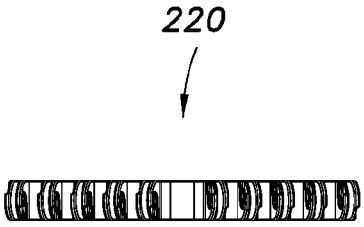
FIG. 96 is a back of the element of FIG. 92.

FIG. 96 is a back of the element 220 of FIG. 92.

Figure 97:
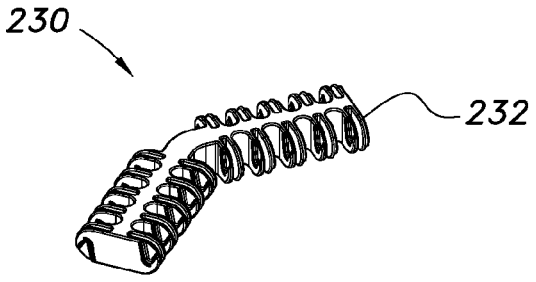
FIG. 97 is a perspective view of an angular element having a 135 degree angle, according to the present invention.

FIG. 97 is a perspective view of an angular element 230 having a 135 degree angle. The element 230 has comb connectors 232, and an angled bend 236.

Figure 98:
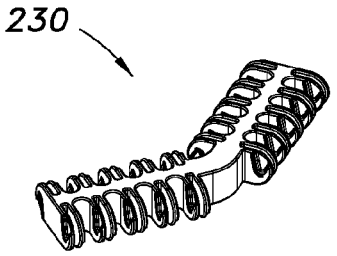
FIG. 98 is another perspective view of the element of FIG. 97.

FIG. 98 is another perspective view of the element 230 of FIG. 97.

Figure 99:
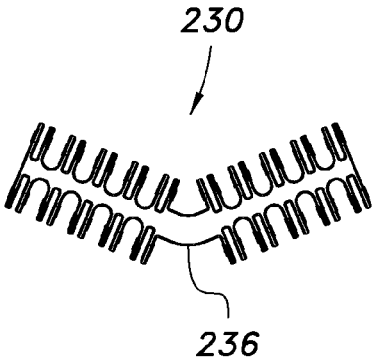
FIG. 99 is a top/bottom view of the element of FIG. 97.

FIG. 99 is a top/bottom view of the element 230 of FIG. 97.

Figure 100:
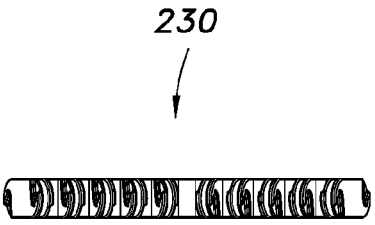
FIG. 100 is a front view of the element of FIG. 97.

FIG. 100 is a front view of the element 230 of FIG. 97.

Figure 101:
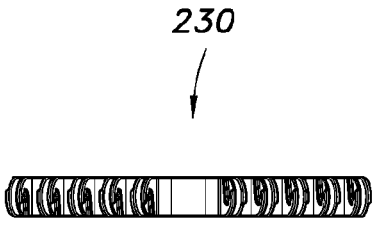
FIG. 101 is a back view of the element of FIG. 97.

FIG. 101 is a back view of the element 230 of FIG. 97.

Figure 102:
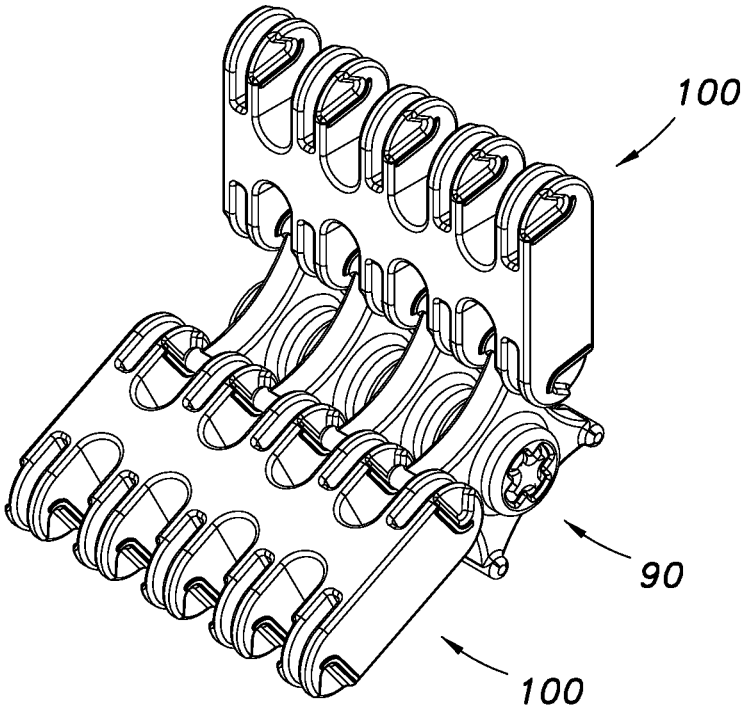
FIG. 102 illustrates a perspective view of a chain-style connection.

FIG. 102 illustrates a perspective view of a chain-style connection wherein element 90 connects two elements 100 which are two-sided comb connectors.

Figure 103:
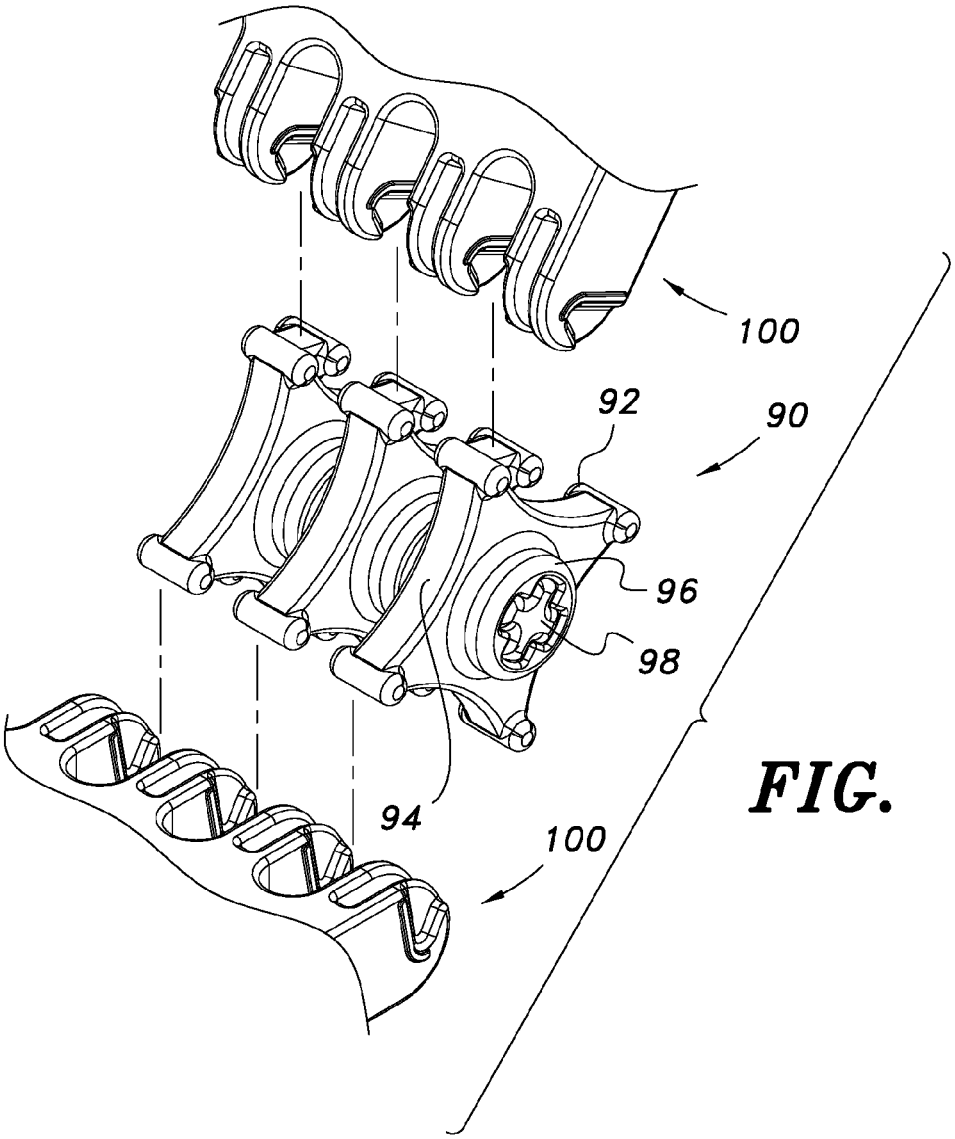
FIG. 103 is an assembly view of the connection of FIG. 103.

FIG. 103 is an assembly view of the connection of FIG. 103.

Figure 104:
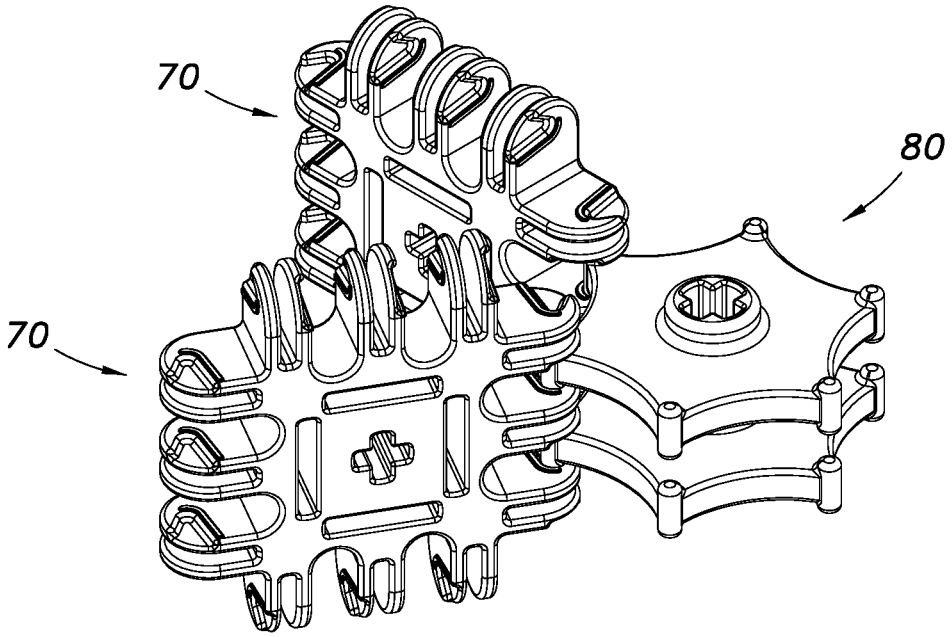
FIG. 104 is a perspective view of a four connection, according to the invention.

FIG. 104 is a perspective view of a four connection wherein element 80 connects two elements 70 which are comb connectors.

Figure 105:
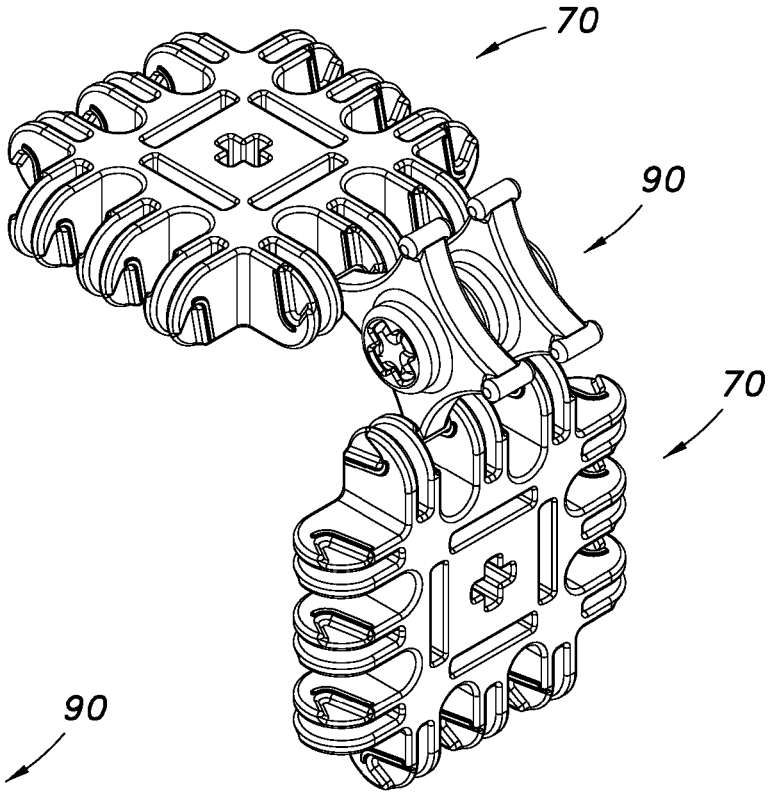
FIG. 105 is a perspective view of a square style connection, according to the invention.

FIG. 105 is a perspective view of a square style connection, wherein element 90 connects two elements 70.

Figure 106:
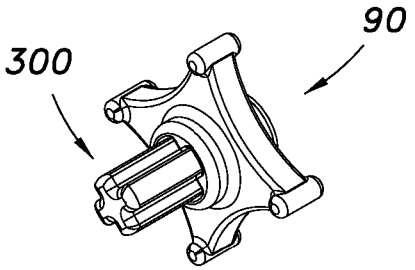
FIG. 106 is a perspective view of a male connector with a pin element, according to the invention.

FIG. 106 is a perspective view of the male connector 90 with a pin element 300. The pin element 300 has a cross-shaped body.

Figure 107:
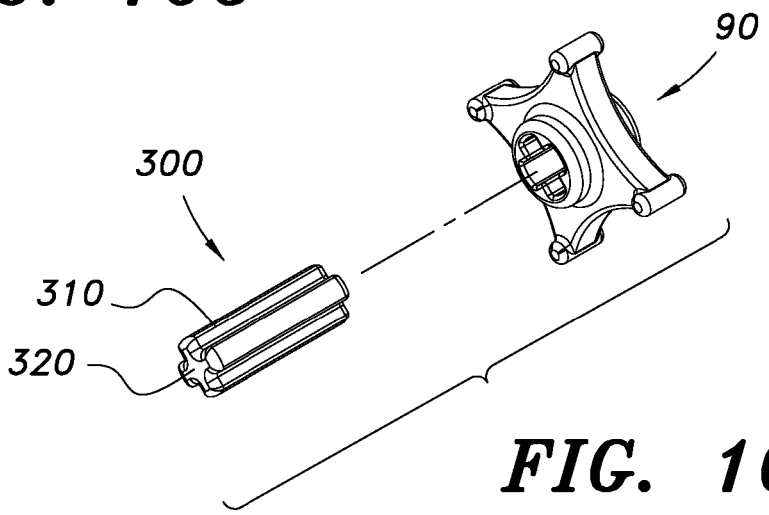
FIG. 107 is an assembly view of the male connector with a pin element of FIG. 106.

FIG. 107 is an assembly view of the male connector 90 with the pin element 300 of FIG. 106.

Figure 108:
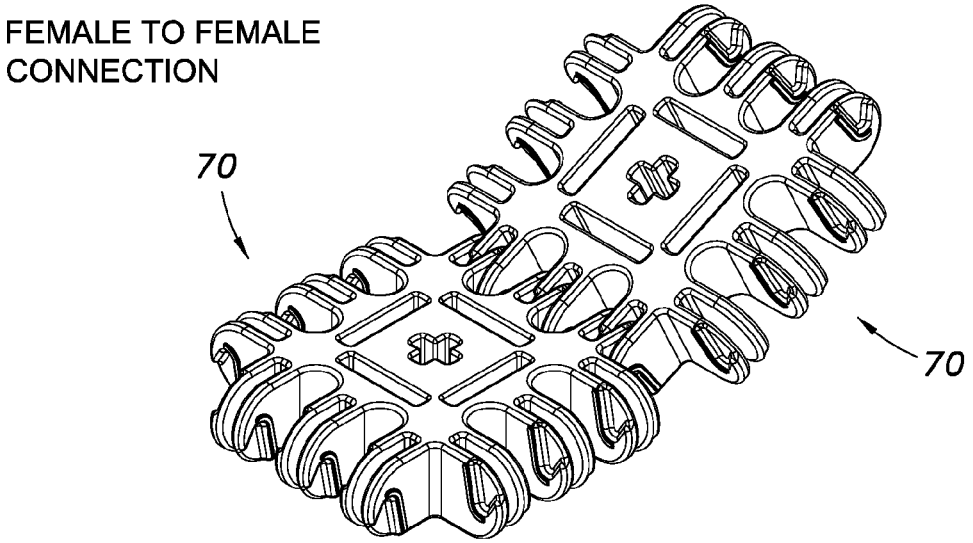
FIG. 108 is a perspective view of a female-to-female connection, according to the invention.

FIG. 108 is a perspective view of a female-to-female connection between two of the elements 70. There is a space at the connection where the lock member can be inserted.

Figure 109:
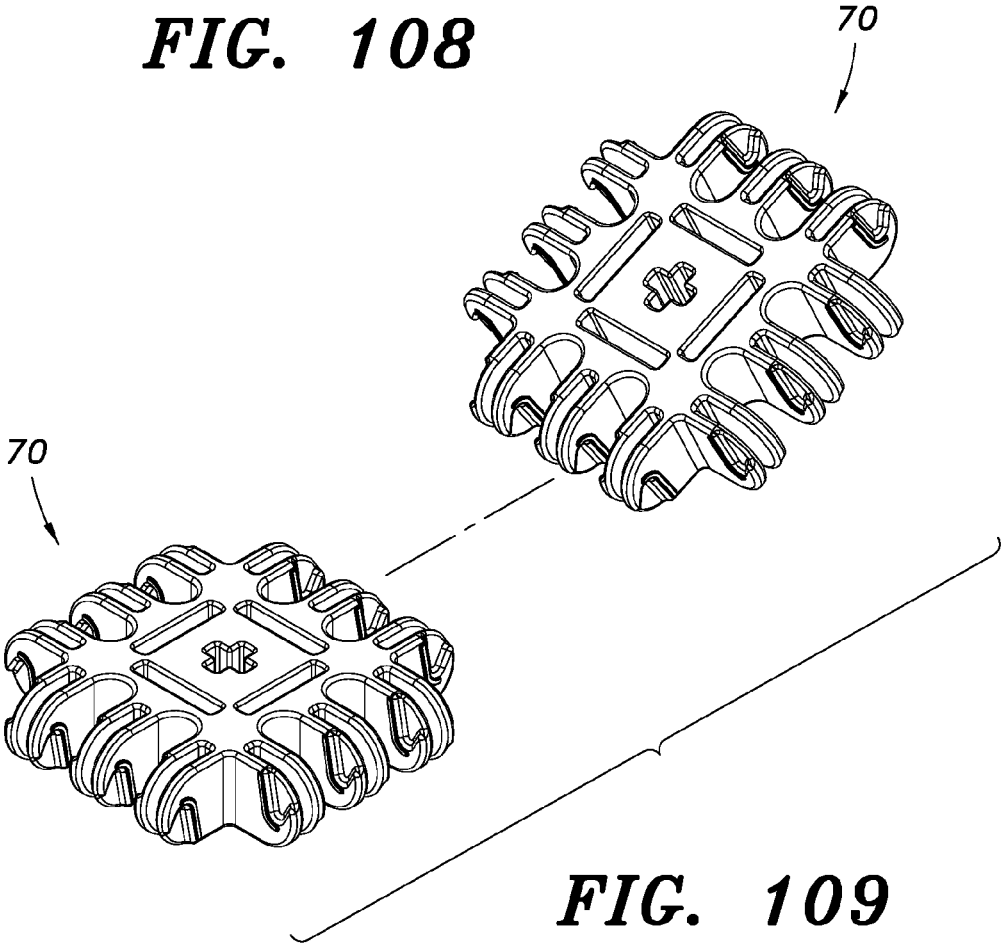
FIG. 109 is a perspective view of a female-to-female connection of FIG. 105.

FIG. 109 is a perspective view of the female-to-female connection of FIG. 105.

Figure 110:
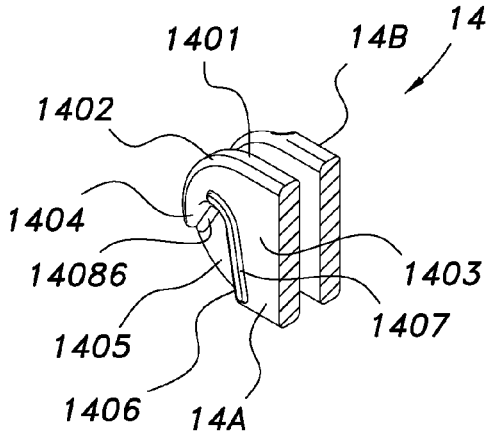
FIG. 110 is a perspective view of a pair of connector members, according to the invention.

FIG. 110 is a perspective view of a connector pair 14 having connector members 14A and 14B. The connector member 14B shows an outer periphery 1401, and a beveled side 1402 leading up to the periphery 1401. The beveling allows for easy slide entry of the male elements.

The connector member 14B also shows an exterior side wall 1403, a curved tip 1404 of the side wall 1403. The curving accommodates the hinge action of the locked elements and also the range of motion of the female-to-female connection. A recessed portion 1405 is also shown, along with a ridge 1406 having a side wall 1407. The side wall 1407 is a brake designed to prevent the accidental overshooting of the nesting of the low stress pinless hinge. The ridge 1406 also serves as a secondary higher tension inner hinge when the male element is forced to cross over it. The member 14A has a similar ridge but in an opposed direction; the two opposed directions of the ridge walls function in a positive manner, and do not allow the male element to easily escape once locked into position.

Figure 111:
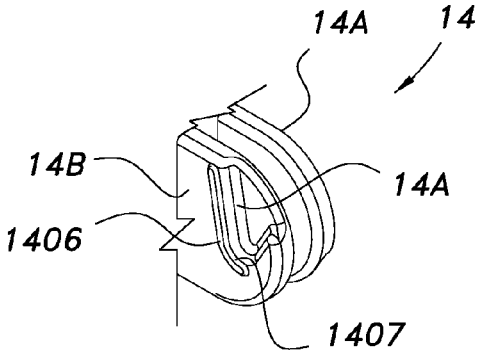
FIG. 111 is another perspective view of the pair of connector members of FIG. 110.

FIG. 111 is another perspective view of the pair of connector members 14A and 14B of FIG. 110.

Figure 112:
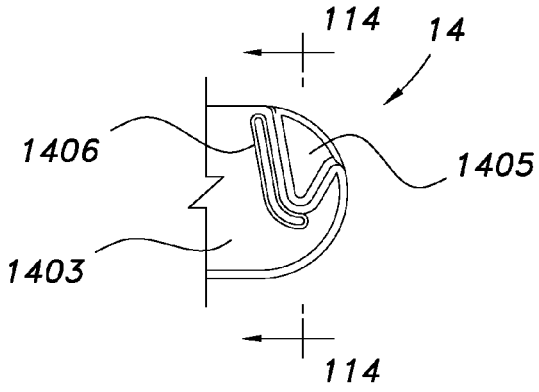
FIG. 112 is an elevational view of one face of one of pair of connector members of FIG. 110.

FIG. 112 is an elevational view of one face of one of pair of connector members 14A and 14B of FIG. 110.

Figure 113:
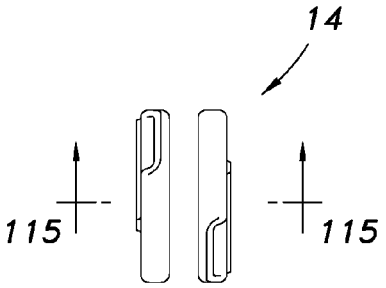
FIG. 113 is a front view of the pair of connector members of FIG. 110.

FIG. 113 is a front view of the pair of connector members 14A and 14B of FIG. 110.

Figure 114:
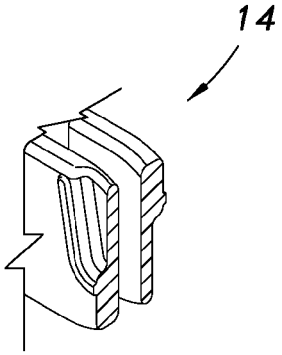
FIG. 114 is a sectional view taken along line X-X of FIG. 112.

FIG. 114 is a sectional view taken along line X-X of FIG. 112.

Figure 115:
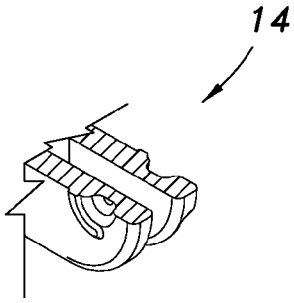
FIG. 115 is a sectional view taken along line Y-Y of FIG. 113.

FIG. 115 is a sectional view taken along line Y-Y of FIG. 113.

Figure 116:
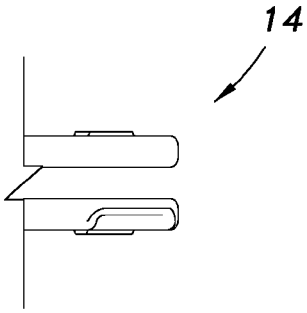
FIG. 116 is a top elevational view of the pair of connector members of FIG. 110.

FIG. 116 is a top elevational view of the pair of connector members 14A and 14B of FIG. 110.

Figure 117:
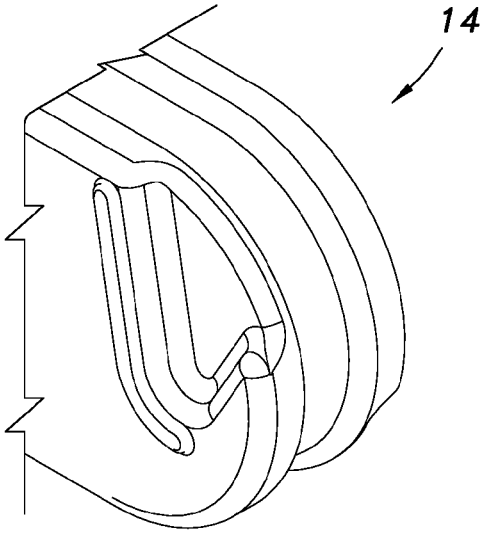
FIG. 117 is an enlarged view corresponding to FIG. 111.

FIG. 117 is an enlarged view corresponding to FIG. 111.

Figure 118:
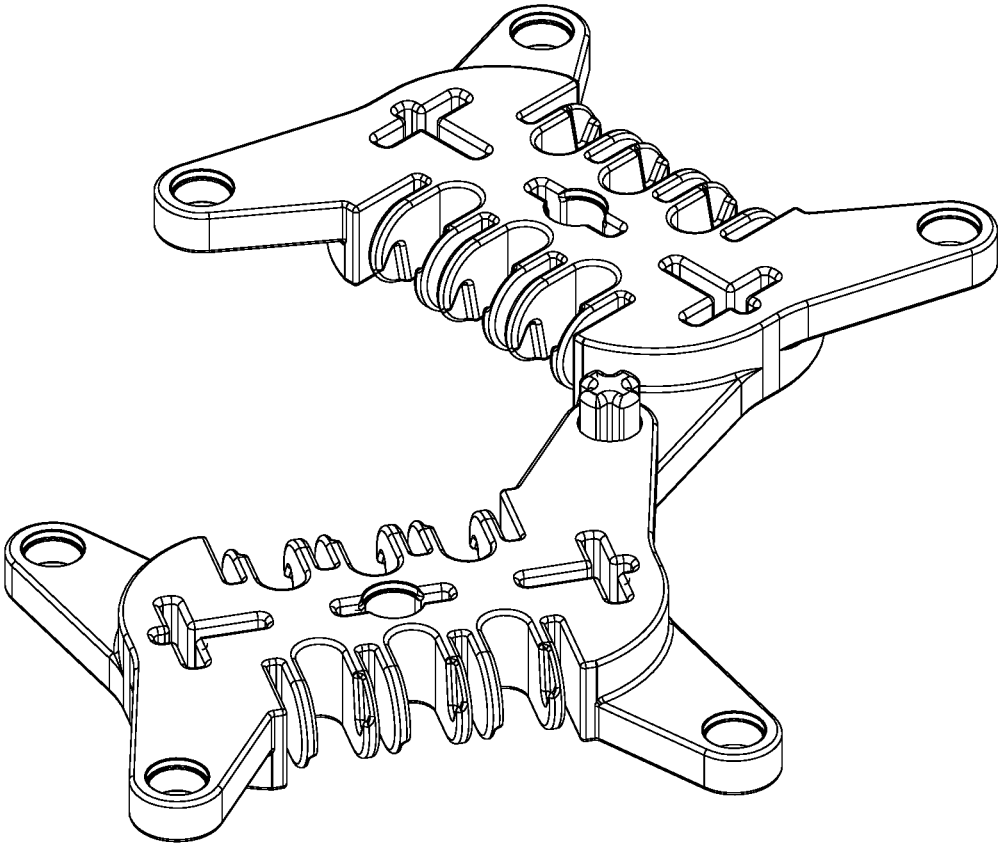
FIG. 118 is a perspective view of a pin connection between two elements.

FIG. 118 is a perspective view of a pin connection between two elements, which form a utility block structure for either closed or indefinite structures. The pinned connection can be a fixed or hinged joint.

Figure 119:
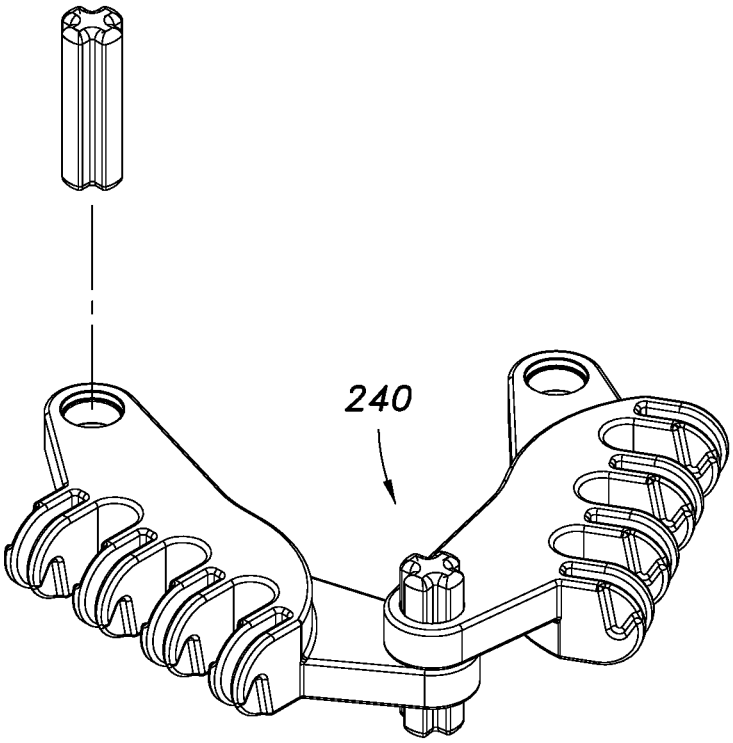

FIG. 119 is an assembly view 240 showing insertion of a pin (unnumbered) into a hole in one of the unity block elements. This assembly can configure the comb connectors of other planar elements, and also offers hinging elements at an angle of 90 degrees to the comb connector hinge.

Figure 120:
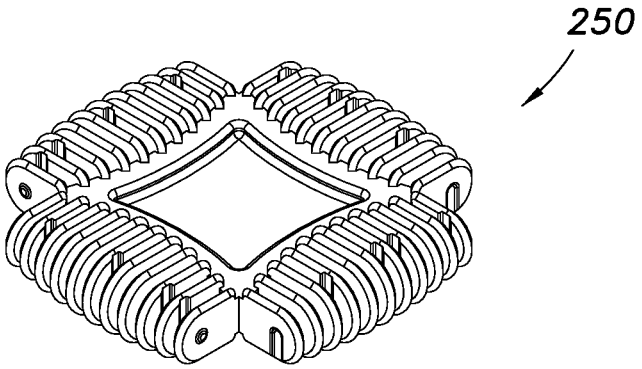

FIG. 120 is a perspective view of a hermaphroditic connector element 250. It has both male and female elements on its blades.

Figure 121:
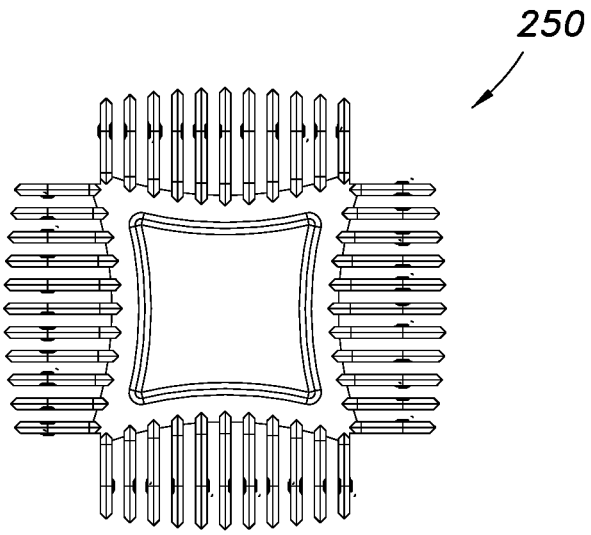

FIG. 121 is a top elevational view of the hermaphroditic connector element 250 of FIG. 120.

Figure 122:
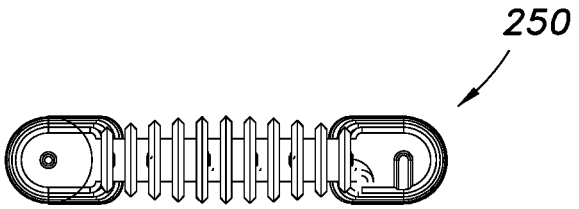

FIG. 122 is a side elevational view of the hermaphroditic connector element 250 of FIG. 120.

FIG. 122 shows a female groove (unnumbered) at the right-most end, and a male boss (unnumbered) at the left-most end.

Figure 123:
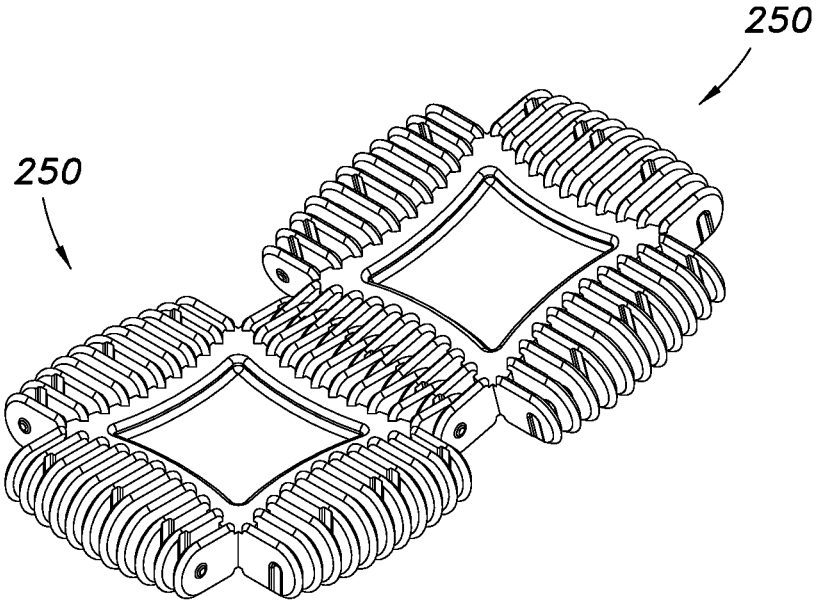

FIG. 123 is a perspective view of the connection of two hermaphroditic connector elements 250 of FIG. 120.

Figure 124:
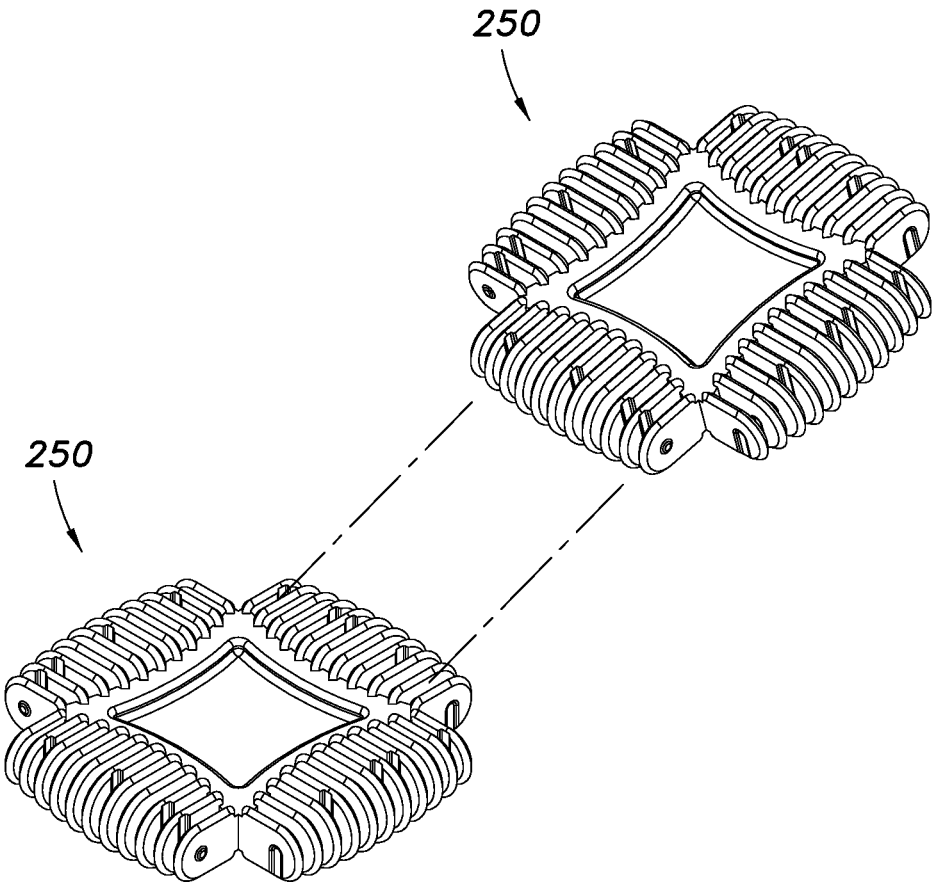

FIG. 124 is an assembly view of the connection of the two hermaphroditic connector elements 250 of FIG. 123.

Figure 125:
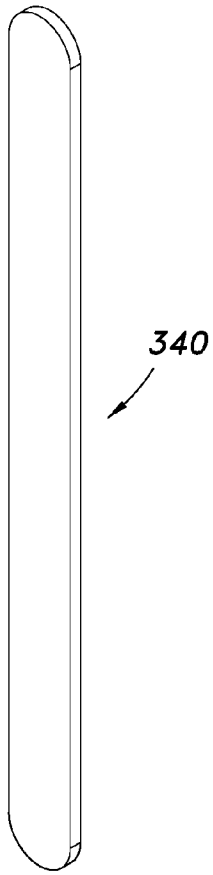

FIG. 125 is a perspective view of a rectilinear structure element 340, which is a stick-like element.

Figure 126:
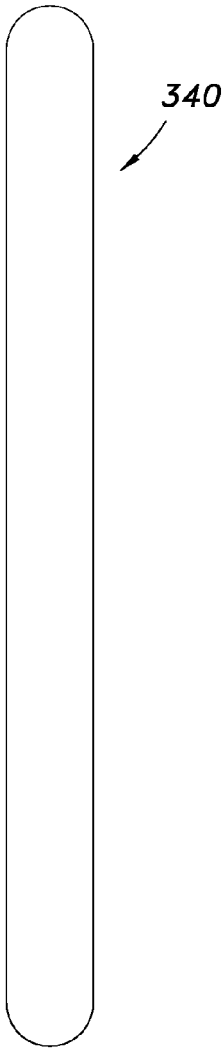

FIG. 126 is a front elevational view of the stick-like element 340 of FIG. 125.

Figure 127:
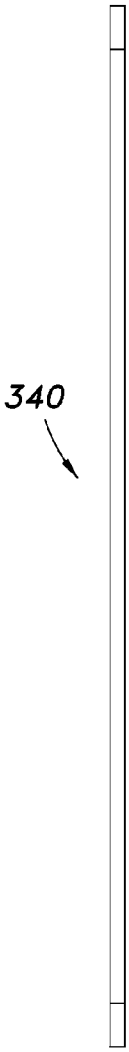

FIG. 127 is a side elevational view of the stick-like element 340 of FIG. 125.

Figure 128:
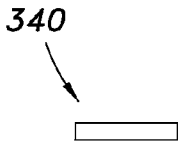

FIG. 128 is an end elevational view of the stick-like element 340 of FIG. 125.

Figure 129:
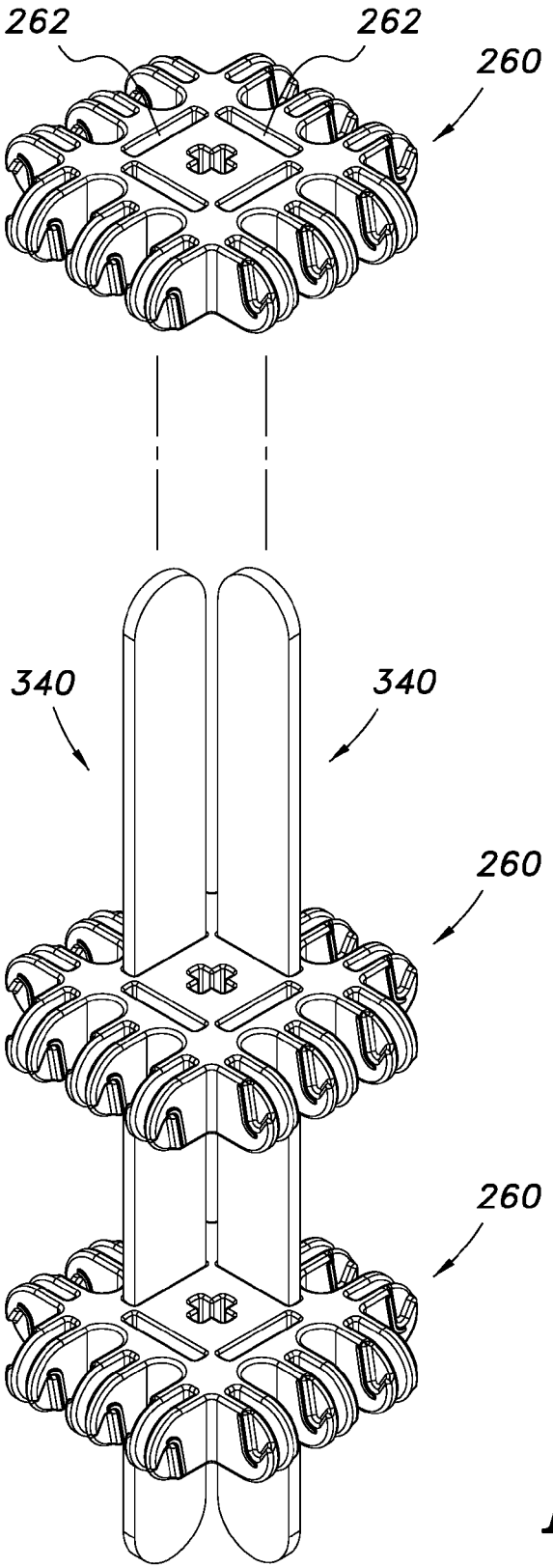

FIG. 129 is an assembly view showing use of the stick connector 340 of FIGS. 125-128 to connect several elements 260.

FIG. 130 is a schematic view of the pin 92 and ridge 1407 connection of two corresponding ones of a pair of connector members 14A and 14B.

FIG. 131 is a schematic view of the insertion of male elements 92 into respective ones of a plurality of pairs of connector members 14.

FIG. 132 is a schematic view showing a zipper-like unlocking of the connections of the male elements 92 of FIG. 131 from respective ones of a plurality of pairs of connector members 14 of FIG. 131.

FIG. 133 is an enlarged view, similar to FIG. 130, showing a different type of locking engagement of the male elements 92 behind the ridge members 1407.

FIG. 134 is a schematic view of the insertion of male elements 92 into respective ones of a plurality of pairs of connector members 14, for the locking arrangement shown in FIG. 133. This is a stressed connection in that the male elements have overshot the ridges 1407 and are locked into place behind them.

FIG. 135 is a schematic view showing the ridge members 1407 in overlapping side view, forming a nearly circular form 600, to illustrate the oppositely directed connecting scheme according to the present invention.

FIG. 136 is a schematic view similar to FIG. 135, showing a plurality of pairs of the ridge members 1407 and male elements 92 in side view, to illustrate the oppositely directed connecting scheme of the present invention.

The principle of the pinless hinge schematically shown in FIG. 136, and as embodied in various ones of the preceding figures, is that approximately half of all male bosses (elements) are free to escape in one direction and the other half are free to escape in the opposite direction. But since they are all connected at the base, they are all thus frozen creating the pinless hinging action or lock. It is a kind of mechanical trap and it is accomplished with semicircular traps aligned at odds from each other. These counteracting semi-circles create an overall effect of complete circles.

The interior ridges behind the female recesses serve two primary functions (but the design of the hinge can work without this ridge). The ridge serves as a brake to keep the male boss from over shooting the recess, but if it does overshoot the recess and jump over this ridge, the bosses are re-trapped in a higher pressure nesting cycle and remain hinges, now fulcrummed or pinned between two counteracting positive ridges. This is shown clearly in FIG. 133, for example.

Regarding the operating principles of the connections, the aforementioned hinge elements can be connected together in a comb like fashion because the gap provided for the bending moment of the individual connector members is a wide enough channel to receive a comb element from another female connector. The female to female connections work by a pressure hold and are not true hinges—except in the case of the hermaphroditic connector, which has male bosses and female recesses that allow for a snapping pitiless hinge without the male secondary element.

The aforementioned hinge, being connected from opposed directions, therefore has a 50-50 built in redundancy that is stronger and relatively more reliable than other types of hinge.

The special advantages to this construction are that it allows for female to female non-hinge assembly (hinged if considering a hermaphrodite comb connector), ease of fabrication in economical two part molds, two snapping and locking sequences (using the female channel to trap the male boss and the ridge to trap the boss).

The hinge of the present invention as shown and described hereinabove has an important advantageous feature in that it can be fabricated economically in a simple two part mold without the aid of more costly molding devices having specialized features like slides and pulls which substantially increase the cost of tooling the mold. This is because the hinge, as conceived, has no undercuts that would hamper the clean symmetrical opening of a two part mold.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A hermaphroditic element for selective manual attachment and manual detachment to a male attachment member which has at least one male element, said hermaphroditic element comprising:

a body having a central body portion and having a plurality of blades extending from said central body portion, wherein adjacent pairs of said plurality of blades form connector pairs, and wherein said adjacent pairs of said plurality of blades are substantially parallel to each other;

each of said connector pairs including a first connector member formed in one of said plurality of blades and a second connector member formed on an adjacent one of said plurality of blades; wherein said first connector member is a female groove and said second connector member is a male boss;

said first connector member having a distal outer periphery and a surface adapted to receive a male connector element, said surface having said female groove adapted to receive a male element; said first connector member ending in a first longitudinal direction, and said female groove extending in a second direction substantially transverse to said first longitudinal direction;

said second connector member having an outer periphery and a surface adapted to receive a male connector element, said surface having said male boss;

said female groove extending to said outer periphery of said first connector member;

said first connector member having a beveled side adjacent its periphery, to facilitate sliding entry of male elements; and wherein said first connector member includes a curved tip.

2. The element as claimed in claim 1, wherein said first connector member and said second connector member are resiliently deformable.

3. The element as claimed in claim 1, wherein said central body portion is a generally rectangular body having four sides, each of said four sides having a plurality of said connector pairs disposed parallel to each other along each respective one of said four sides.

4. The element of claim 1, wherein first connector member has a substantially flat rectangular portion having an upper edge and a lower edge, and said female groove of said first connector member is a substantially linear groove which extends from a central region of said first connector member to said upper edge of said substantially flat rectangular body.

* * * * *